US010130138B2

(12) United States Patent
Neiley

(10) Patent No.: US 10,130,138 B2
(45) Date of Patent: Nov. 20, 2018

(54) EXOSKELETAL BOOT

(71) Applicant: APEX SPORTS GROUP, LLC, Boulder, CO (US)

(72) Inventor: Roger Thompson Neiley, Laguna Beach, CA (US)

(73) Assignee: APEX SPORTS GROUP, LLC, Golden, CO (US)

( * ) Notice: Subject to any disclaimer, the term of this patent is extended or adjusted under 35 U.S.C. 154(b) by 0 days.

(21) Appl. No.: 15/004,612

(22) Filed: Jan. 22, 2016

(65) Prior Publication Data

US 2017/0208892 A1 Jul. 27, 2017

(51) Int. Cl.

| | |
|---|---|
| ***A43B 11/00*** | (2006.01) |
| ***A43C 11/00*** | (2006.01) |
| ***A43C 11/14*** | (2006.01) |
| ***A43C 11/16*** | (2006.01) |
| ***A43B 5/04*** | (2006.01) |

(52) U.S. Cl.

CPC ..... *A43B 5/0405* (2013.01); *A43B 5/0488* (2013.01); *A43C 11/008* (2013.01); *A43C 11/1406* (2013.01); *A43C 11/165* (2013.01)

(58) Field of Classification Search

CPC ..... A43B 5/04; A43B 5/0405; A43B 5/0409; A43B 5/0427; A43B 5/0429; A43B 5/0431; A43B 4/0433; A43B 5/0435; A43B 5/0443; A43B 5/0445; A43B 5/0447; A43B 5/0452; A43B 5/0454; A43B 5/0466; A43B 5/0468; A43B 5/047; A43B 5/0474; A43B 5/0476; A43B 23/26; A43B 23/02; A43B 23/0245; A43C 1/003; A43C 1/04; A43C 3/00; A43C 11/003; A43C 11/008; A43C 11/1406; A43C 11/16

USPC ..... 36/118.2, 50.5, 117.4, 50.1, 54

See application file for complete search history.

(56) References Cited

U.S. PATENT DOCUMENTS

| | | | | | |
|---|---|---|---|---|---|
| 384,437 | A * | 6/1888 | Frantz | A43B 23/02 | 36/47 |
| 830,753 | A * | 9/1906 | Voss | A43B 23/047 | 36/51 |
| 1,127,037 | A * | 2/1915 | Lippiello | A43B 23/02 | 36/48 |
| 1,697,893 | A * | 1/1929 | Winlow | A43C 1/04 | 24/713.3 |
| 2,069,381 | A * | 2/1937 | Morgan | A43B 3/126 | 36/11.5 |

(Continued)

*Primary Examiner* — Jameson Collier
*Assistant Examiner* — Heather Mangine
(74) *Attorney, Agent, or Firm* — Procopio, Cory, Hargreaves & Savitch LLP; Lisel M. Ferguson

(57) ABSTRACT

A walking boot and a boot frame. The boot frame can be formed to receive the walking boot. The walking boot can be secured within the boot frame via one or more buckles. The walking boot can have an externally mounted tongue that can be tensioned via the use of one or more laces and associated tensioning mechanisms. The tongue can be molded to conform to a user's foot and leg while the tensioning mechanisms secure the user's foot and leg within the walking boot. In some embodiments, the boot frame has an open heel to capture the walking boot. In some other embodiments, the boot frame has a rotatable heel configured to pivot away from the toe and receive a heel of the walking boot for easy coupling of the walking boot to the boot frame.

4 Claims, 19 Drawing Sheets

(56) References Cited

U.S. PATENT DOCUMENTS 2,444,428 A * 7/1948 Carrier ..... A43B 5/0427 36/105
3,169,325 A * 2/1965 Fesl ..... A43B 5/0486 36/117.1
3,530,594 A * 9/1970 Vogel ..... A43B 1/14 36/117.1
3,538,627 A * 11/1970 Honore ..... A43B 5/0415 280/611
3,636,642 A * 1/1972 Walther ..... A43B 5/0415 36/117.4
3,783,534 A * 1/1974 Phillips ..... A43B 5/145 36/131
3,854,743 A * 12/1974 Hansen ..... A43B 5/0415 280/618
4,630,383 A * 12/1986 Gamm ..... A43B 3/0031 36/134
4,955,149 A * 9/1990 Ottieri ..... A43B 5/0435 36/117.8
5,117,567 A * 6/1992 Berger ..... A43B 1/0072 36/50.1
5,235,613 A * 8/1993 Brown ..... H04B 1/713 375/135
5,325,613 A * 7/1994 Sussmann ..... A43C 11/00 24/712.2
5,327,662 A * 7/1994 Hallenbeck ..... A43C 11/00 36/50.1
5,329,706 A * 7/1994 Pozzobon ..... A43B 5/04 36/117.1
5,341,583 A * 8/1994 Hallenbeck ..... A43C 11/00 36/50.1
5,437,466 A * 8/1995 Meibock ..... A43B 5/0401 280/11.202
5,651,197 A * 7/1997 James ..... A43B 7/1495 36/50.1
5,664,344 A * 9/1997 Marmonier ..... A43B 5/0401 36/117.3
5,701,688 A * 12/1997 Crowley ..... A43B 23/26 36/101
5,775,009 A * 7/1998 Marega ..... A43B 5/1641 36/117.5
5,791,021 A * 8/1998 James ..... A43C 1/003 24/68 SK
5,794,362 A * 8/1998 Polk, III ..... A43B 3/26 280/7.13
6,012,237 A * 1/2000 Okajima ..... A43B 5/0401 36/117.1
6,016,614 A * 1/2000 Best ..... A43B 5/0466 36/117.1
6,052,921 A * 4/2000 Oreck ..... A43C 1/00 36/50.1
6,173,510 B1 * 1/2001 Zanco ..... A43B 5/0401 36/103
6,226,898 B1 * 5/2001 Trimble ..... A43B 3/0047 36/10
6,408,542 B1 * 6/2002 Shepherd ..... A43B 5/00 36/114
6,412,794 B1 * 7/2002 Phillips ..... A43B 3/0073 280/14.22
6,467,193 B1 * 10/2002 Okajima ..... A43B 5/0405 36/10
6,543,159 B1 * 4/2003 Carpenter ..... A43B 3/0073 36/115
6,681,503 B2 * 1/2004 Morle ..... A43B 5/02 36/133
7,040,042 B2 * 5/2006 Light ..... A43B 5/04 36/117.1
7,231,699 B2 * 6/2007 Borsoi ..... A43C 7/00 24/136 A
7,281,341 B2 * 10/2007 Reagan ..... A43B 3/0031 36/50.1
7,392,603 B1 * 7/2008 Shepherd ..... A43B 23/26 36/114
7,444,768 B2 * 11/2008 Friton ..... A43B 23/26 36/50.1
7,464,492 B2 * 12/2008 Marechal ..... A43B 5/1625 36/115
7,963,049 B2 * 6/2011 Messmer ..... A43B 5/0401 36/117.6
8,065,820 B2 * 11/2011 Sartor ..... A43C 11/142 36/117.1
8,141,273 B2 * 3/2012 Stramare ..... A43C 7/08 24/134 P
8,161,664 B1 * 4/2012 Dawson ..... A43B 1/0054 36/54
8,468,657 B2 * 6/2013 Soderberg ..... A43C 11/16 24/68 SK
8,474,157 B2 * 7/2013 Motawi ..... A43B 3/0031 36/117.1
9,248,040 B2 * 2/2016 Soderberg ..... A61F 5/028
9,723,891 B2 * 8/2017 Xanthos ..... A43C 11/1493
9,867,431 B2 * 1/2018 Harley ..... A43C 13/00
2001/0018805 A1 * 9/2001 Basso ..... A43B 1/0081 36/10
2002/0053147 A1 * 5/2002 Borsoi ..... A43B 5/0401 36/54
2002/0078597 A1 * 6/2002 Burt ..... A43B 7/12 36/51
2002/0088146 A1 * 7/2002 Joseph ..... A43B 5/04 36/117.3
2003/0110664 A1 * 6/2003 Caeran ..... A43B 5/0415 36/118.2
2004/0074110 A1 * 4/2004 Borsoi ..... A43B 5/0405 36/50.5
2004/0159017 A1 * 8/2004 Martin ..... A43B 3/0047 36/50.5
2005/0022427 A1 * 2/2005 Kerns ..... A43B 5/14 36/50.1
2005/0102861 A1 * 5/2005 Martin ..... A43C 1/003 36/50.5
2006/0162187 A1 * 7/2006 Byrnes ..... A43B 3/06 36/54
2006/0162192 A1 * 7/2006 Roux ..... A43B 1/0072 36/118.2
2006/0196083 A1 * 9/2006 Martin ..... A43B 5/0401 36/50.5
2007/0227045 A1 * 10/2007 Aveni ..... A43B 3/24 36/54
2008/0168685 A1 * 7/2008 Kim ..... A43C 1/003 36/115
2009/0031585 A1 * 2/2009 Shepherd ..... A43B 1/0081 36/89
2009/0090026 A1 * 4/2009 Mosher ..... A43B 23/26 36/54
2009/0100712 A1 * 4/2009 Baker ..... A43B 5/02 36/99
2010/0175278 A1 * 7/2010 Seliger ..... A43B 5/0401 36/117.1
2010/0180471 A1 * 7/2010 Dodge ..... A43B 5/04 36/117.3
2013/0086818 A1 * 4/2013 Donnadieu ..... A43B 5/0411 36/115
2013/0118040 A1 * 5/2013 Rastello ..... A43B 3/06 36/118.2
2015/0313318 A1 * 11/2015 Gibb ..... A43C 11/00 36/58.5
2015/0342304 A1 * 12/2015 Modena ..... A43B 5/0401 36/115
2016/0192729 A1 * 7/2016 Rastello ..... A43B 5/0476 36/117.7
2017/0105487 A1 * 4/2017 Klein ..... A43B 23/0245
2017/0151488 A1 * 6/2017 Schroeder ..... A63C 9/003
2017/0202297 A1 * 7/2017 Parisotto ..... A43B 5/0405
2017/0202310 A1 * 7/2017 Spanks ..... A43B 3/101
2017/0216710 A1 * 8/2017 Debney ..... A43B 5/0401
2017/0245595 A1 * 8/2017 Ramos ..... A43B 23/00

* cited by examiner

EXOSKELETAL BOOT

FIELD OF INVENTION

This application involves footwear for use with sports equipment. More specifically, this invention relates to snow sport boots.

BACKGROUND

Many boot and binding combinations, especially in the skiing industry, have a rigid or semi-rigid boot mounted to a binding that is in turn mounted to an athletic device, such as a ski or a snowboard. The rigid boots can surround and secure the users feet providing the needed connection between the feet and the device. In some examples, a similar construction can be used with a snowboard or other applications that can require a secure connection between user and device. In some examples, a wakeboard, surfboard, skateboard, roller skate, ice skate, or other device can also require such a secure connection.

However, a rigid or semi-rigid boot, while providing a responsive connection to the device, often restricts the user from bending his or her feet at the ankle, making the boot uncomfortable and walking difficult. A semi-rigid outer shell surrounding the foot also can make entry into the boots inconvenient for the user.

The closure around the foot of conventional types of footwear can be designed with a tongue positioned internal to the side panels. The tongue can be drawn toward the dorsal surface of the foot and anterior surface of the lower leg via laces or other closure means which alternately cross from one side of the boot to the other, over the outer surface of the tongue. Tightening the laces creates a set of radial closure forces, the vectors of which are often positioned diagonally across the top of the foot. When loosened, the footwear is allowed to open sufficiently for entry and exit of the foot, while closure draws the tongue and side panels together to reduce the interior volume of the footwear.

Laces positioned on the exterior surface of the conventional boot generally are hindered in their closure action by three factors. First, the friction of each lace sliding against the exterior surface of the boot, second, by lace-to-lace contact where two portions of a lace cross and impinge on each other, and third, by the fact that laces are most commonly arranged in such a way that their path over the top of the foot is angular. This angularity of lace pathways naturally increases as the boot's side panels are drawn toward each other. To effectively tighten the boot, both the frictional losses and the decreasing mechanical advantage of diagonally positioned laces must be overcome by the user, either through manual or mechanical means of tensioning the laces. The end result is that more effort is required to achieve a desired degree of closure, and in many cases, a desired level of support cannot be achieved.

In addition to the closure deficiency caused by conventional laces, the common positioning of the boot's tongue inside the side panels of the boot can be problematic. Pressure points against the foot and leg created by the edges of the tongue are a common fitting complaint. And while it is desirable to keep the foot clean and dry in a hostile environment, the dorsal surface of a conventional tongue, lying below the surface of the side panels, encourages snow, water, and contaminants to gather on the outer surface of the tongue and eventually often enter the boot to affect the foot. Robust gusseting and other sealing means are normally employed to avoid intrusion of these elements into the boot, but many users find that leakage eventually takes place after prolonged use.

Ski boots can be designed with an all-encompassing shell of moderately rigid material, typically injection molded in polyurethane or polyether thermoplastic resins. The resulting shell forms a highly supportive structure around the foot and lower leg which allows for a skier's body motions to be transmitted to the skis for turning and control maneuvers. This well-developed state of the art yields good performance but suffers from three main deficiencies:

First, the rigidity of the outer shell imposes fit constraints on the user. The range of closure to accommodate various foot and leg geometries is limited by the lack of flexibility of the shell material. Stiffer shells perform better but at the sacrifice of closure range and comfort. Softer shells sacrifice efficient energy transfer and skiing performance but may accommodate a wider variety of foot shapes.

Second, the rigidly closed structure, which typically extends above the ankle joint, impedes natural walking. With the foot thus enclosed and unable to make use of its normal range of motion, walking and other activities such as climbing stairs are found to be awkward and uncomfortable.

Third, the relatively dense polymer shells of conventional ski boots typically have high heat transfer characteristics which lead to the common complaint of ski boots being cold. Additional insulation added between shell and foot may reduce heat transfer but can create a bulky, heavier boot than desired.

SUMMARY

In general, this disclosure describes elements of an exoskeletal boot. The exoskeletal boot can have a removable, relatively soft walking boot secured within a more rigid external structure or frame that can be secured by a binding to a ski, for example. The exoskeletal boot is described herein with primary application to skis and ski boots for convenience. It should be appreciated that the disclosed devices and methods can be readily applied to other disciplines. The exoskeletal boot can be applied wherever a combination of softer, relatively flexible components with harder, supporting elements is desired. For example, such applications can include but are not limited to ice and roller skates, snowboarding boots, protective footwear, medical footwear, and mountaineering equipment. Some embodiments of the medical footwear can include orthopedic and/or footwear used in occupational or physical rehabilitation. Other applications requiring a rigid connection at the foot are also envisioned by this disclosure.

The deficiencies in the common ski boot have led to the development of this invention. This invention is composed of a relatively soft and flexible boot, similar to a typical snowboarding boot, which envelopes the foot with closure mechanisms that allow for secure closure and support for extended ranges of foot volumes. With a high-traction outsole and flexibility in the ankle area, this "walking boot" allows for a comfortable and more natural gait, and increased foot dexterity. To provide rigid attachment points between boot and ski, and to add the necessary support for modern skiing maneuvers, this walking boot is received into an exoskeletal boot frame fabricated of materials more rigid than conventional ski boots. The exoskeletal boot frame can also be referred to herein as a frame, a boot frame, or a chassis. The frame can be sufficiently open such that entry of the walking boot into the chassis is convenient, and when coupled, the softer walking boot and chassis become an integrated unit, suitable for modern skiing maneuvers.

Flexible but inelastic straps typically provide primary retention of the walking boot into the chassis while a variety of possible lacing systems close the walking boot to the foot. However, since the loads exerted by a skier to control his or her skis can be multidirectional and of high magnitudes, a secure and powerful closure around the foot along with additional engagement between walking boot and chassis is desirable so as to avoid impairment of performance due to relative motion between the foot, the walking boot and the chassis. To meet the convenience demands of consumers, such coupling means must be intuitive, durable, and easy to operate in a hostile environment.

In order to maintain the shortest possible overall sole length, it is also desirable that material thickness of any engagement between the hard and soft boot components be minimized at the extreme front and rear ends of the boot.

The devices of this disclosure each have several innovative aspects, no single one of which is solely responsible for the desirable attributes disclosed herein.

One aspect of the disclosure provides a ski boot. The ski boot can have a walking boot having an externally mounted tongue with at least one lace routed internally in the tongue. The ski boot can also have a boot frame having one or more buckles, a toe section, and a heel section. The boot frame can receive and secure the walking boot. The walking boot and boot frame can be securely coupled to one another through the use of the one or more buckles to form an integrated unit which can be accepted into a ski binding.

Another aspect of the disclosure provides a ski boot. The ski boot can have a walking boot. The walking boot can have a lateral panel, a medial panel, and an externally mounted tongue having at least one lace routed internally in the tongue, the at least one lace configured to draw the tongue toward the lateral panel and the medial panel. The ski boot can also have a boot frame operable to receive and secure the walking boot. The boot frame can have a shank having a heel cup and a toe cup coupled by a structural bridge. The boot frame can also have a lateral frame support having a first flange, the lateral frame support being coupled to the shank. The boot frame can also have a medial frame support having a second flange, the medial frame support being coupled to the shank. The boot frame can also have a rear connector adjustably coupled to the first flange and the second flange. The boot frame can also have at least a first buckle coupled to the lateral frame support and the medial frame support. The boot frame can also have a cuff adjustably coupled to the connector, the cuff having at least a second buckle.

Another aspect of the disclosure provides a ski walking boot for use with an exoskeletal ski boot. The walking boot can have a lateral panel having a first edge. The walking boot can also have a medial panel joined to the lateral panel by a back panel, the medial panel having a second edge. The walking boot can also have a tongue having an upper portion, a lower portion, a lateral edge, and a medial edge. The lateral edge can overlie the first edge and the medial edge can overlie the second edge. The walking boot can also have at least one lace routed internally in the tongue, the at least one lace configured to draw the tongue toward the lateral panel and the medial panel.

Another aspect of the disclosure provides a ski boot. The ski boot can have a walking boot. The walking boot can have a toe section, a heel section, and tongue. The tongue can be externally-mounted to the walking boot and secured by at least one lace. The ski boot can also have a boot frame having a toe cup and a rotatable heel cup arranged on a centerline. The rotatable heel cup can rotate away from the centerline. The rotatable heel cup can also accept the heel section to the rotatable heel cup. The rotatable heel cup can also rotate the toe section toward the toe cup. The boot frame can also have a plurality of buckles configured to secure the heel section to the rotatable heel cup and the toe section to the toe cup.

Other features and advantages of the present disclosure should be apparent from the following description which illustrates, by way of example, aspects of the disclosure.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. In some instances, well-known structures and components are shown in simplified form for brevity of description.

The exoskeletal boot as described herein improves the security of attachment and functional integration between elements of the boot. The boot minimizes the relative motion between the two different boot components, walking boot and frame, when engaged, to improve energy transfer, proprioception for the user and control of any conveyance structures such as skis or wheels which are attached to the boot assembly. The boot further allows for adjustments in the toe, instep and heel areas to provide additional security of engagement and fine-tuning of the boot fit for the various physiologies of users, shapes and volumes of the walking boot or types of use. The resulting sole length of this boot is shorter than previous boots allowing for increased performance.

Figure 1:
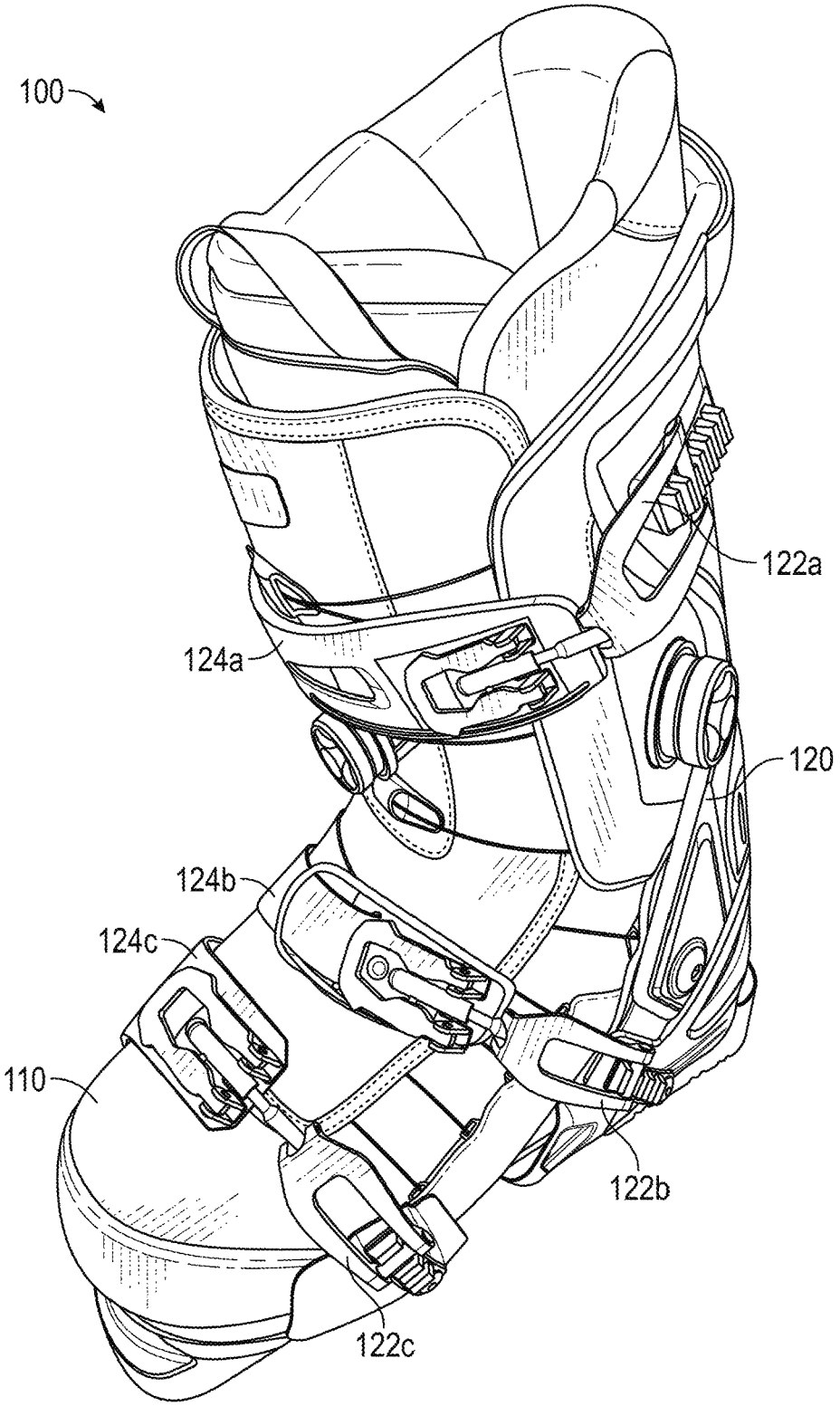
FIG. 1 is a perspective view of an embodiment of an exoskeletal boot.

FIG. 1 is a perspective view of an embodiment of an exoskeletal boot. An exoskeletal boot 100 can have a walking boot 110 surrounded by a frame 120. The frame 120 may also be referred to herein as a chassis or a boot frame. The walking boot 110 can readily be removed or decoupled from the frame 120 via the use of one or more buckles 122, straps, or other means of engagement.

The walking boot 110 can be formed from relatively flexible material to allow the wearer (e.g., a user) to have some range of motion of the ankle some range of closure of the structure providing a comfortable fit. The flexible material further allows easier walking and a comfortable and more natural gait, when compared to a rigid boot (e.g., a standard ski boot). In some examples, the walking boot 110 can also allow the user to go about daily tasks with reasonable foot dexterity, accomplishing activities not possible with a standard ski boot. Additional features of the walking boot 110 are described in connection with the following figures.

The frame 120 can be sized to accept the walking boot 110 in a clearance fit and be secured in place via the one or more buckles 122. Three buckles 122 are depicted and labeled as an upper buckle 122*a*, instep buckle 122*b*, and toe buckle 122*c*. Only three buckles 122 are depicted, however in some embodiments there are more or fewer buckles 122. The walking boot 110 can be inserted into the frame 120 and secured in place using the buckles 122. To provide attachment points between the exoskeletal boot 100 and, for example, a ski, the frame 120 can have a toe sole and a heel sole (described below in connection with FIG. 9). The frame 120 can receive the walking boot 110 to provide the desired structure for modern skiing maneuvers.

In some embodiments, the frame 120 can be fabricated of relatively rigid materials such as, for example, fiber-reinforced plastic (FRP), carbon fiber, or similar composite materials. Conventional ski boots are commonly made of injection molded polyurethane or polyether-thermoplastic resins. These, similar to most plastics, can be heavier and more flexible than the FRP, carbon fiber, or other composites used to form the frame 120. Such lighter and stiffer composites can provide higher strength to weight and volume, reducing the overall size of, primarily the frame 120, but also the walking boot 110 and the exoskeletal boot 100 as a whole.

In some embodiments, the frame 120 can be formed having an opening sufficient to allow convenient entry of the walking boot 110. When coupled, the softer and more flexible walking boot 110 and frame 120 become an integrated unit, the exoskeletal boot 100, suitable for modern skiing maneuvers.

Each of the buckles 122 can be associated with a strap. In an embodiment, the upper buckle 122*a* can be coupled to an upper strap 124*a*. The instep buckle 122*b* can be coupled to a flexible Y-shaped strap 124*b*. The toe buckle 122*c* can be associated with a toe strap 124*c*. Each of the buckles 122 and their associated straps 124 can be adjusted to provide a secure and/or rigid connection between the walking boot 110 and the frame 120. In some embodiments, the straps 124 can be fabricated of molded plastic, fabric, or other flexible material.

In some embodiments, the straps 124 can be flexible but inelastic. Accordingly, the straps 124 in conjunction with the buckles 122 can provide primary retention of the walking boot 110 into the chassis (e.g., the frame 120). In some embodiments, such as for example a ski boot, the loads exerted by a skier to control his or her skis can be multidirectional and of high magnitudes. Therefore a highly secure closure around the foot along with additional engagement between walking boot 110 and the frame 120 is desirable. A more rigid or secure engagement can avoid impairment of performance due to relative motion between the wearer's foot, the walking boot 110, and the frame 120.

Figure 2:
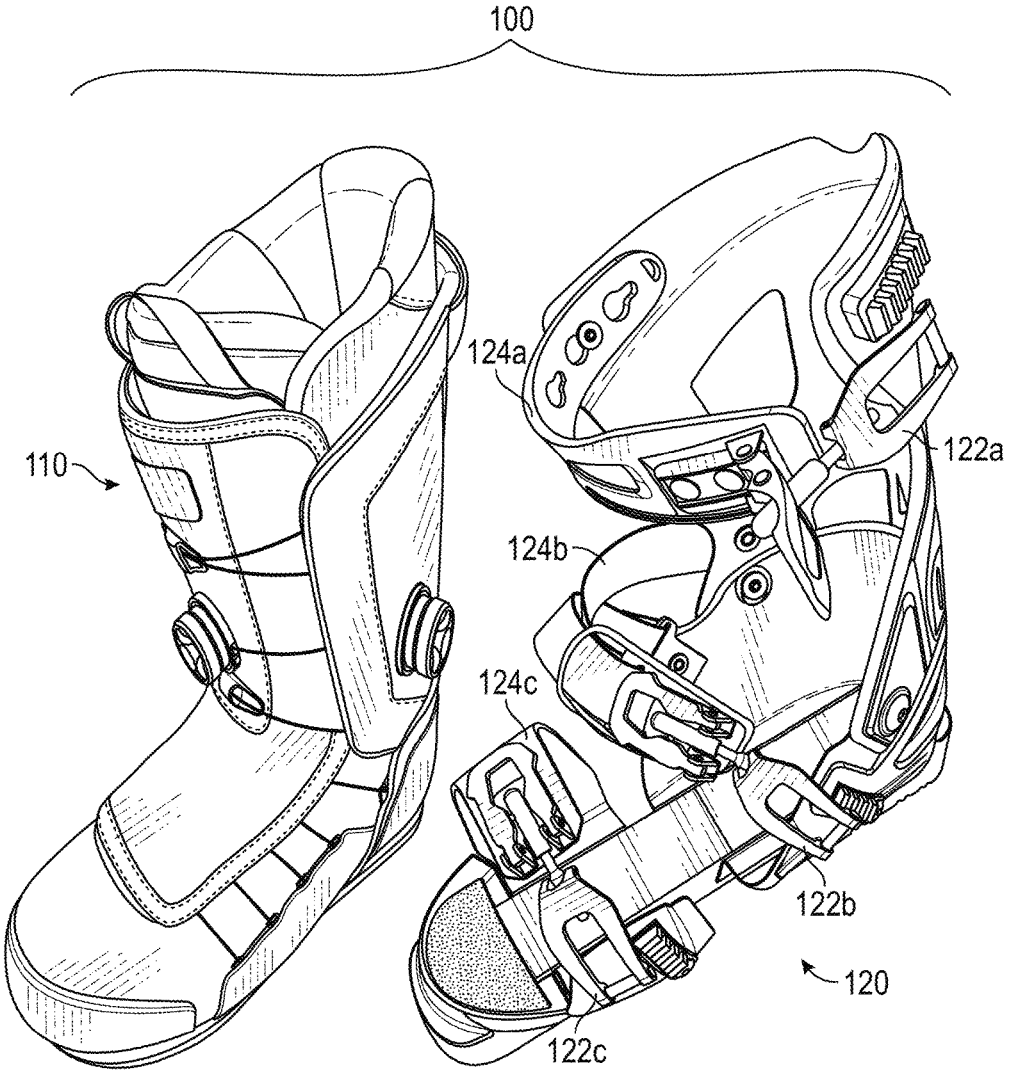
FIG. 2 is an exploded view of the exoskeletal boot of FIG. 1.

FIG. 2 is an exploded view of the exoskeletal boot of FIG. 1. As noted above, the walking boot 110 can be readily removed or decoupled from the frame 120 via the use of the buckles 122. The interior geometry of the frame 120 can be designed to closely match the exterior geometry of the walking boot 110, such that when integrated the two components become a single functional assembly.

Figure 3:
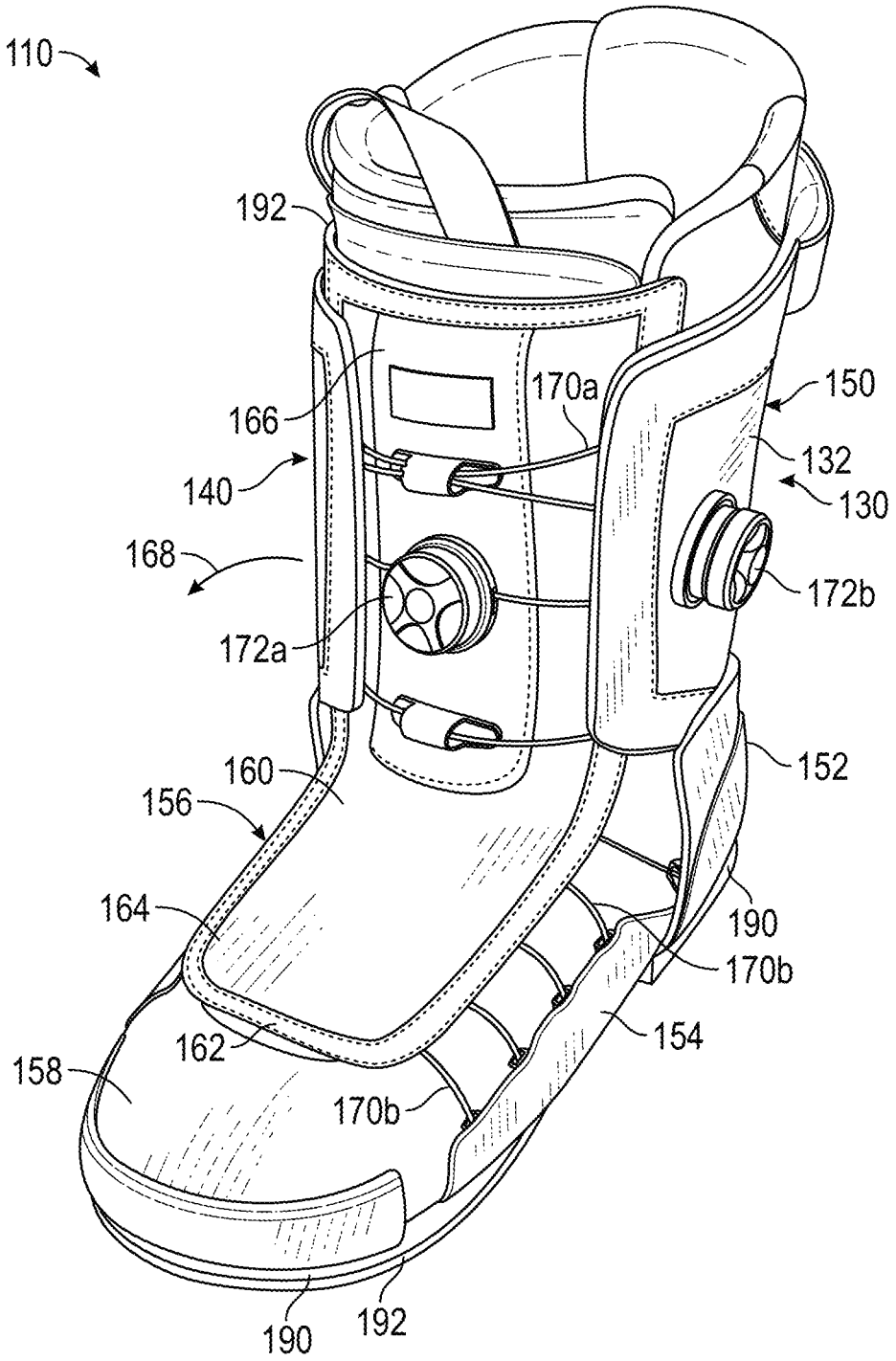
FIG. 3 is a front perspective of an embodiment of a walking boot of the exoskeletal boot of FIG. 1.

FIG. 3 is a front perspective of an embodiment of the walking boot of the exoskeletal boot of FIG. 1. The walking boot 110 can have a lateral side 130 having a lateral panel 132 and a medial side 140 having a medial panel 142. The lateral panel 132 and the medial panel 142 can be connected by a back panel 150. The walking boot 110 can also have a heel 152 and a toe section 158. The lateral panel 132 can have, an outer mid-foot panel 154 (on the lateral side 130), while the medial panel 142 can have an inner mid-foot panel 156 (on the medial side 140). In some examples, the outer mid-foot panel 154 and the inner mid-foot panel 156 may be described as separate sections or portions of the walking boot 110. Each of the foregoing sections can be a part of a unitary molding for the walking boot 110. In some embodiments, one or more of the foregoing panels can be stitched or otherwise fastened together to form the structure of the walking boot 110. In some embodiments, fastening the various panels together in such a way may allow for a certain degree of articulation between the panels.

The walking boot 110 can also have a tongue 160. The tongue 160 can be positioned externally to the adjacent lower panels of the walking boot 110, namely the lateral panel 132, the medial panel 142, the outer mid-foot panel 154, the inner mid-foot panel 156, and the toe section 158. The tongue 160 can be molded to provide overlap with the adjacent panels while also remaining flexible such it can conform to the wearer's foot and leg when in use and fastened. In some embodiments, a lower portion 164 of the tongue 160 can overlap with the inner mid-foot panel 156 and the outer mid-foot panel 154. Similarly, an upper portion 166 of the tongue 160 can overlap with the lateral panel 132 and the medial panel 142. In some embodiments, the lower portion 164 of the tongue 160 can be disposed on top of the inner mid-foot panel 156 and the outer mid-foot panel 154, while the upper portion 166 of the tongue 160 can overlap beneath the lateral panel 132 and the medial panel 142. In some other embodiments, the tongue 160 can be the outermost layer of the walking boot 110 (see, e.g., FIG. 5). That is, the tongue 160 is disposed atop the lateral panel 132, the medial panel 142, the inner mid-foot panel 156 and the outer mid-foot panel 154.

In some embodiments, a forward edge 162 of the tongue 160 can be affixed to the toe section 158. In such an embodiment, the tongue 160 can hinge upward and forward in a direction indicated by an arrow 168. The tongue 160 can be attached to the toe section 158 via stitching or other fixed-position fastening means. In some embodiments, the tongue 160 can be connected via a connector (not shown) allowing a predefined amount of fore-aft movement of the tongue 160 as it is drawn toward the user's foot. Such an embodiment can allow the tongue 160 to settle in a position during closure that follows the contour of the user's foot and leg within the walking boot 110.

The walking boot 110 can also have one or more closure laces (laces) 170. The laces 170 are depicted as two laces 170*a* and 170*b*, but may be collectively referred to as the laces 170. When loosened, the laces 170 allow convenient entry for the user's foot into the walking boot 110. The laces 170 can be tightened to secure the user's foot and leg within the walking boot 110 using a tensioning mechanism 172. The tensioning mechanism 172 can be a reel or other system operable to tighten the laces 170. A forward tensioning mechanism 172*a* and a lateral tensioning mechanism 172*b* are shown in this view, but they may be collectively referred to herein as the tensioning mechanisms 172. In some embodiments, tensioning of the laces 170 may also be effected by simple manual tensioning, with a desired level of lace tension maintained by knotting the lace or other fixation means (not shown).

In an embodiment, the tongue 160 can be a three-dimensionally molded panel of a semi-flexible material, such that the default shape of the tongue 160 mimics the dorsal or anterior surface of the user's foot and leg. The three dimensional molding further allows the tongue 160 to adapt to different foot shapes or morphologies.

Following entry of the foot into the walking boot 110, the tongue 160 can be drawn downward and rearward, resting upon the lower panels of the boot and effectively becoming integral to the overall boot body as laces 170 are tightened.

In some embodiments, the walking boot 110 can further have a sole 190 having certain traction elements 192 for walking.

Figure 4:
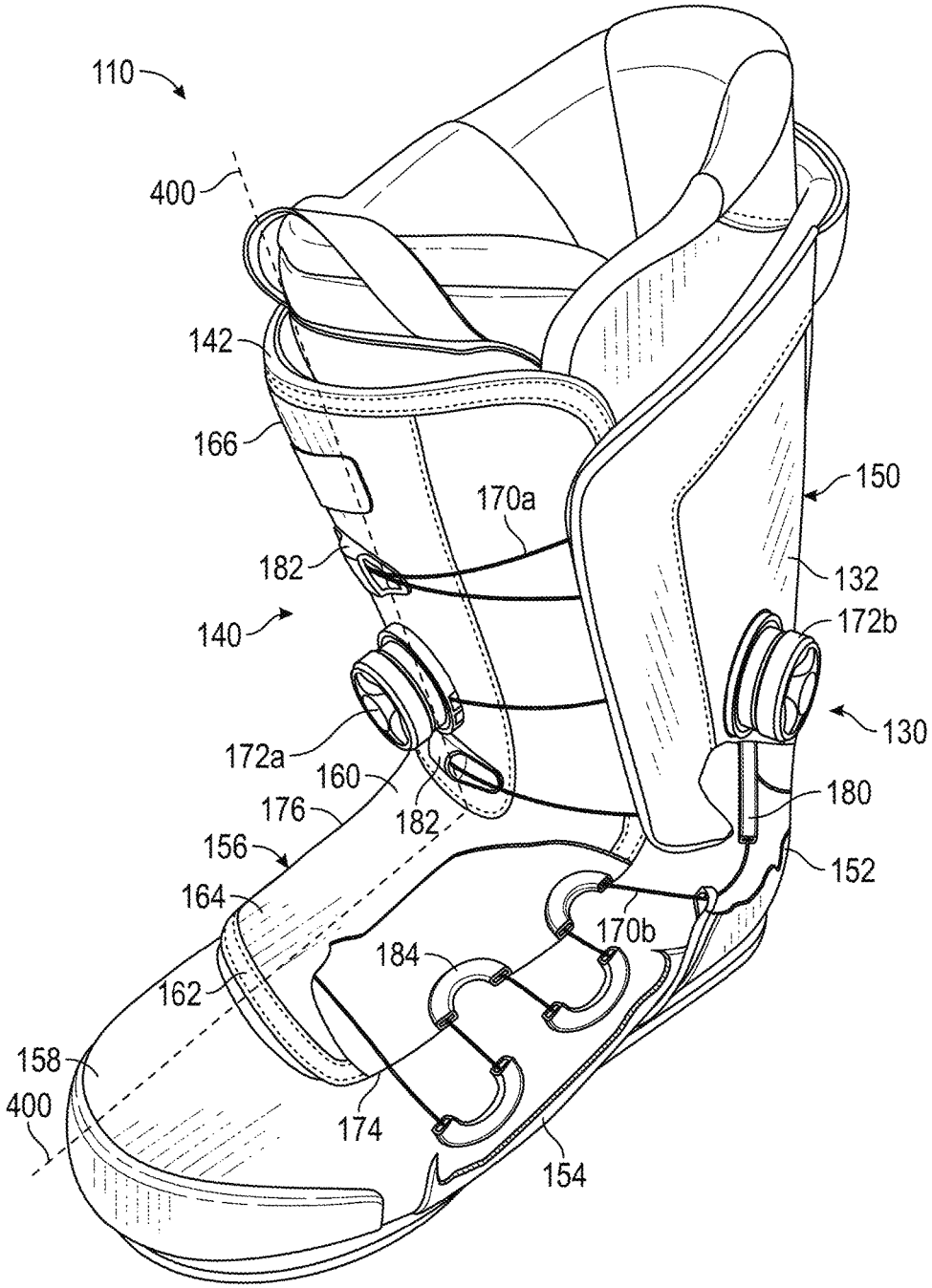
FIG. 4 is a cutaway view of the walking boot of FIG. 3.

FIG. 4 is a cutaway view of the walking boot of FIG. 3. The laces 170*a* can be routed in a serpentine path between the lateral panel 132 and the medial panel 142, across the upper portion 166 of the tongue 160. Similarly, the laces 170*b* can be routed in a serpentine path between inner mid-foot panel 156 and the outer mid-foot panel 154 across or through the lower portion 164 of the tongue 160. In such an embodiment, one or more lace channels 180 can be located, formed within, or affixed to the tongue 160. The lace channels 180 can provide a path to allow at least a portion of the laces 170*a*, 170*b* to be routed internally within the lower portion 164 and/or the upper portion 166 of the tongue 160. The lace channels 180 can be formed as guides 182 that can be affixed to the upper portion 166 of the tongue 160, for example, in order to provide a dedicated path for the laces 170 (e.g., the laces 170*a*) as they cross the exterior of the tongue 160.

In some embodiments, the lace channels 180 can be disposed along the edges of the panels and be arranged such that the laces 170 do not cross the tongue 160. For example, the lace channels 180 can be formed as turning guides 184 disposed on the lateral side 130 of the lower portion 164 and on the outer mid-foot panel 154. One or more turning guides 184 can be embedded or formed within a lateral edge 174 or a medial edge 176 of the tongue 160. In some embodiments a similar configuration can be implemented on the inner mid-foot panel 156 and the medial side 130 of the lower portion 164 of the tongue 160. Such a configuration can improve the efficiency of the lace 170 closure over other embodiments in which the laces 170 (e.g., the laces 170*a*) cross over the tongue 160.

Figure 7:
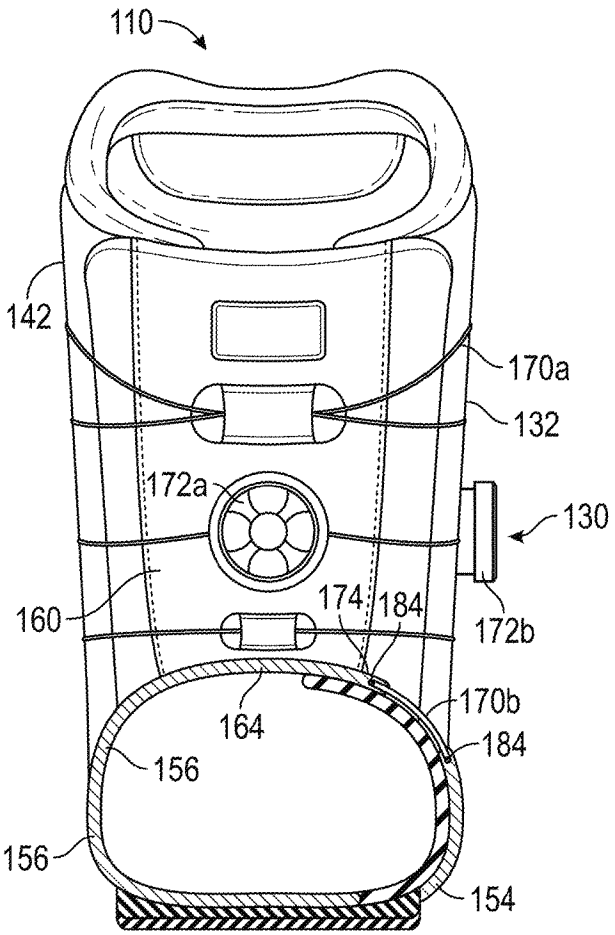
FIG. 7 is another embodiment of the cross section of FIG. 6.

In some embodiments, the lace channels 180 can be symmetrical between the lateral side 130 and the medial side 140 of the walking boot 110. In some embodiments, the laces 170 can be routed on only on one side (e.g., the lateral side 130 or the medial side 140) of the walking boot 110. This configuration is shown in FIG. 7.

The lace channels 180, the turning guides 184, and the guides 182 can be positioned anywhere between the lower/trailing edges of the tongue 160, the lateral panel 132, the medial panel 142, the heel 152. In some embodiments, the pathways of the laces 170 do not cross a centerline 400 of the tongue 160. The centerline 400 is shown in a dashed line and extends along the center of the tongue 160, or shin portion of the walking boot 110 and forward along the top of the foot or instep (e.g., the lower portion 164).

In some embodiments, the lace channels 180 and the guides 182 can be disposed such that the path of laces 170 is substantially parallel to the desired closure direction of the tongue. This can provide the shortest possible length for the laces 170 reducing cost and lace stretch. The substantially parallel path can further provide an effective closure of the tongue 160 to the adjacent panels of the walking boot 110 because tension vectors applied to tongue 160 by the laces 170 are aligned with the desired closure direction of the tongue 160 when tightened. The alignment of the closure direction with the tension vectors can improve the security of the closure. The undulating or serpentine pathway followed by the laces 170, through low friction guides (e.g., the lace channels 180, guides 182, and the turning guides 184), can act similar to a pulley system to provide an increased mechanical advantage to the closure. In some embodiments, this can increase the level of comfort experienced by the user as less tension may be required in comparison to an embodiment where the path of the laces 170 is not aligned with the closure.

Figure 5:
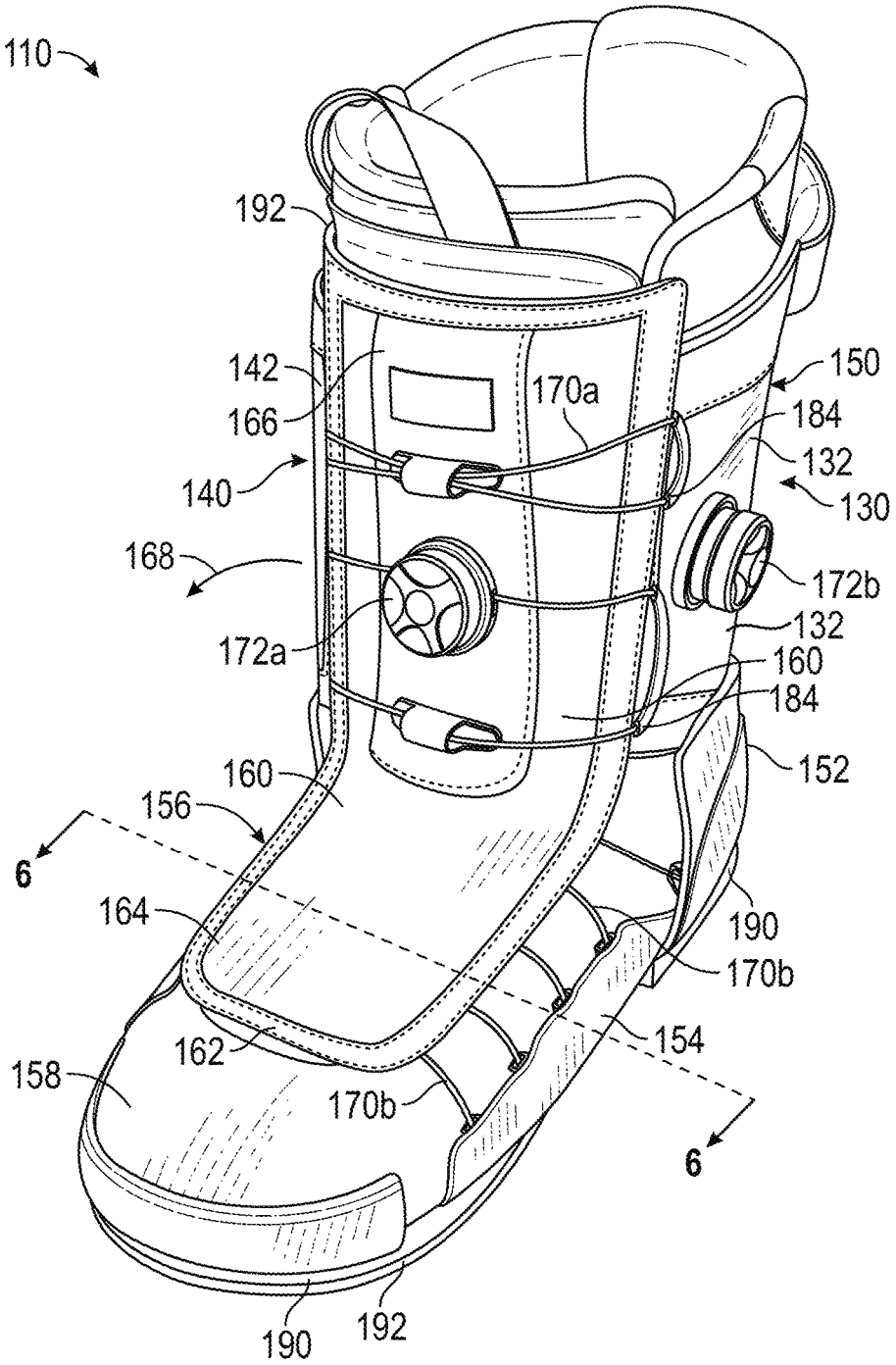
FIG. 5 is a front perspective of another embodiment of the walking boot of the exoskeletal boot of FIG. 1.

FIG. 5 is a front perspective of another embodiment of the walking boot of the exoskeletal boot of FIG. 1. In some embodiments, the tongue 160 can remain external to adjacent side panels of the walking boot 110 as shown. Thus, the upper portion 166 can overlie (e.g., lie outside of) the lateral panel 132 and the medial panel 142, and the lower portion 164 overlies the outer mid-foot panel 154 and the inner mid-foot panel 156. In this embodiment, a serpentine pathway for the laces 170*a* laces is provided using lace channels 180 or the turning guides 184 arranged for the upper portion 166 and the lower portion 164. In this embodiment, the tensioning mechanism(s) 172 may be located directly on the tongue 160 (e.g., the forward tensioning mechanism 172*a*), or may be positioned remotely, such as on the side or back of the boot (e.g., the lateral tensioning mechanism 172*b*). This can provide a smooth surface for the tongue 160 without the protrusion of a reel or other tensioning mechanism 172. In some embodiments, the closure is achieved through the tensioning of the laces 170 with the majority of the lace turning points (e.g., the turning guides 184) located within or on the tongue 160 at the lateral edge 174 and the medial edge 176 between the lower portion 164 and center line 400 of the tongue 160, and from those points to the forward edges of the side panels (e.g., the lateral panel 132 and medial panel 142), rather than crossing over the forward surface of the tongue 160. Though not depicted herein, the serpentine path of the laces 170 can be applied to the upper portion 166 of the tongue 160, such that the laces 170 do not cross the tongue 160.

Figure 6:
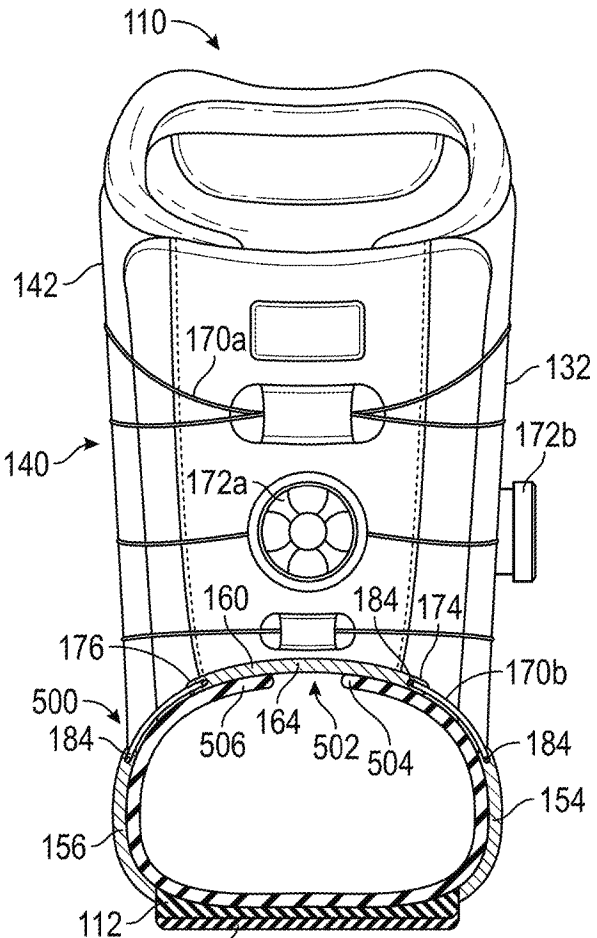
FIG. 6 is a front elevation view of an embodiment showing a cross section of the toe of the walking boot taken along the line 6-6 of FIG. 3.

FIG. 6 is a front elevation view of an embodiment of the walking boot showing a cross section of the toe of the walking boot taken along the line 6-6 of FIG. 5. In some embodiments, a mid-foot area 500 of the walking boot 110 can have the tongue 160 external to all of the adjacent panels. As shown, the tongue 160 overlies the outer mid-foot panel 154 and the inner mid-foot panel 156. Such a placement of the tongue 160 can reduce water intrusion and cause water or other contaminants to flow off the walking boot 110 rather than into the walking boot 110.

The lace channels 180 and the turning guides 184 can be formed within the lateral edge 174 and the medial edge 176 of the tongue. Positioning laces 170*b* on each side of the tongue 160 (e.g., both the lateral side 130 and the medial side 140), allows easy opening for entry of the wearer's foot. Additionally, the tensioning mechanism 172 can draw the tongue 160 rearward and downward onto the lower side panels (e.g., the outer mid-foot panel 154 and the inner mid-foot panel 156) of the walking boot 110, thus securing the wearer's foot internally. In another embodiment, the walking boot can also employ a manual tensioning means such as manually pulling and securing the laces through tying or other means of fixation.

In some embodiments, a predetermined amount of space 502 exists under the tongue 160 and between the top edges 504, 506 of the outer mid-foot panel 154 and the inner mid-foot panel 156, respectively. This can allow higher closure pressures on the medial side 140 and the lateral side 130 of the wearer's foot rather than only on the top (dorsal) surface of the wearer's foot. This is beneficial as the top of the foot can be a sensitive area for some users.

FIG. 7 is another embodiment of the cross section of FIG. 6. In an embodiment, a mid-foot area 600 of the walking boot 110 can have the tongue 160 coupled or connected to the inner mid-foot panel 156, or the medial panel 142. In some embodiments, the tongue 160 can be a unitary portion of the medial panel 142. In some embodiments, the tongue 160 can be affixed, attached, or otherwise connected to the lateral panel 132.

As shown, the tongue 160 can extend upward from the inner mid-foot panel 156, overlying the dorsal surface of the walking boot 110, with the lateral edge 174 connected to the outer mid-foot panel 154 via the lace 170*b*. The lace 170*b* can have a serpentine path between the turning guides 184 on the lower portion 164 of the tongue 160 and the lateral panel 132, as described above. Such an embodiment can provide certain weather-proofing benefits for overall boot structural integrity having fewer openings. Similar to above, the lace 170*b* can be led to the tensioning mechanism 172*b* via one or more lace channels 180 (e.g., the guides 182 and the turning guides 184).

Figure 8:
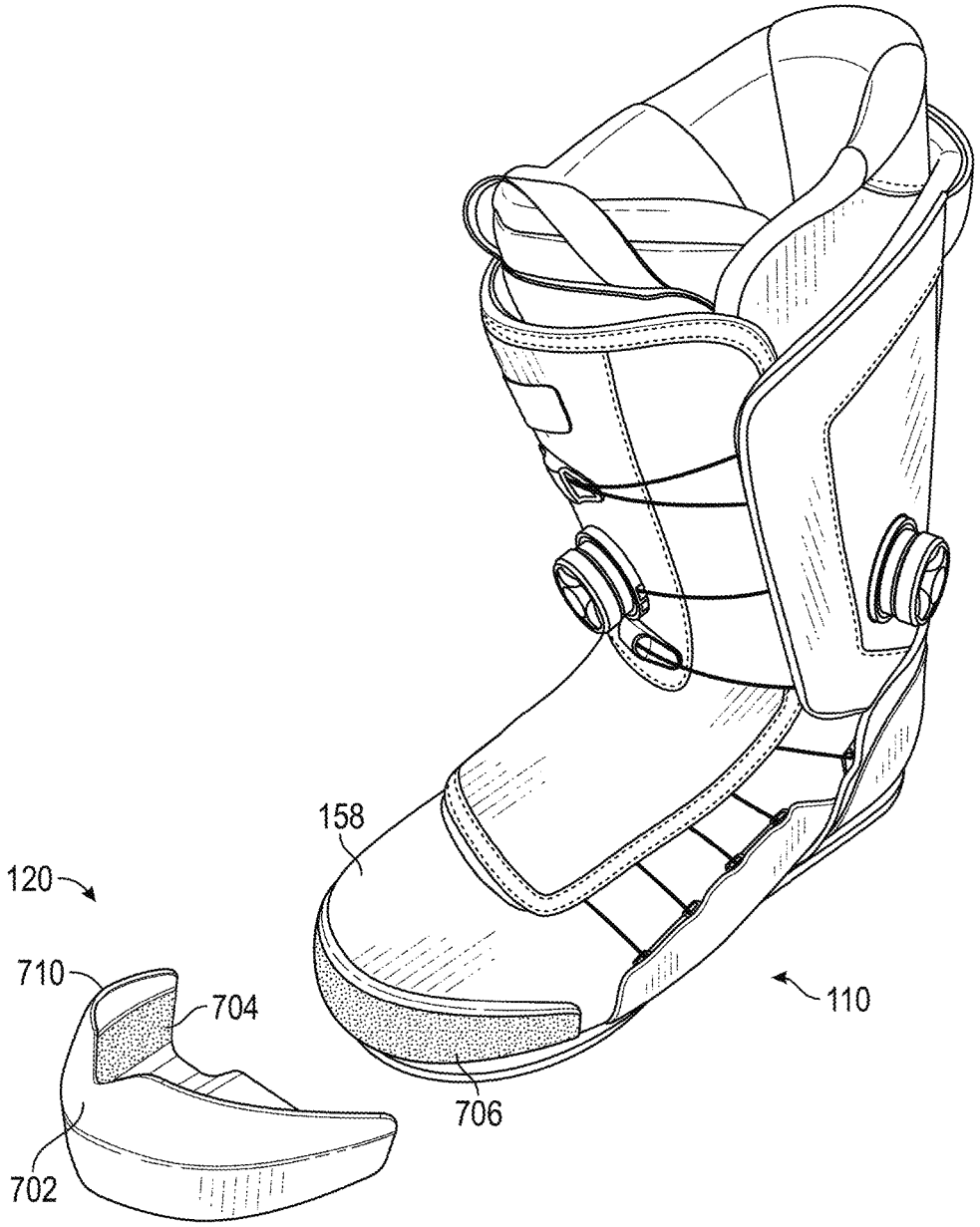
FIG. 8 is an exploded view of toe of the walking boot and a portion of the frame of FIG. 2.

FIG. 8 is an exploded view of toe of the walking boot and the frame of FIG. 2. In an embodiment, as the walking boot 110 is inserted into the frame 120, the toe section 158 can come in contact with a toe cup 702 of the frame 120. This figure shows an interior view of the toe cup 702 and toe section 158. In some embodiments, the toe cup 702 can have a textured surface 704. The toe section 158 can have an analogous textured surface 706. When the walking boot 110 is inserted in frame 120, the textured surfaces 704, 706 of the exoskeletal boot 100 can be in contact presenting a high-friction relationship. The textured surfaces 704, 706 can then provide increased stability and a more secure connection to the walking boot 110 within the frame 120 when the straps 124 and buckles 122 are tightened.

In some embodiments, the textured surfaces 704, 706 can thus provide a means of limiting relative motion between the toe section 158 of the walking boot 110 and the toe cup 702, by increasing friction between the two parts. This can be done without the need for additional mechanical fasteners (e.g., the buckles 122) or inconvenient engagement geometries between the walking boot 110 and the frame 120.

In some other embodiments, the toe cup 702 can have a top section 710 that can curve over or overlap the toe section 158 of the walking boot 110. The overlap of the top section 710 with the toe section 158 of the walking boot 110 can provide additional rigidity and stability of the exoskeletal boot 100.

Figure 9:
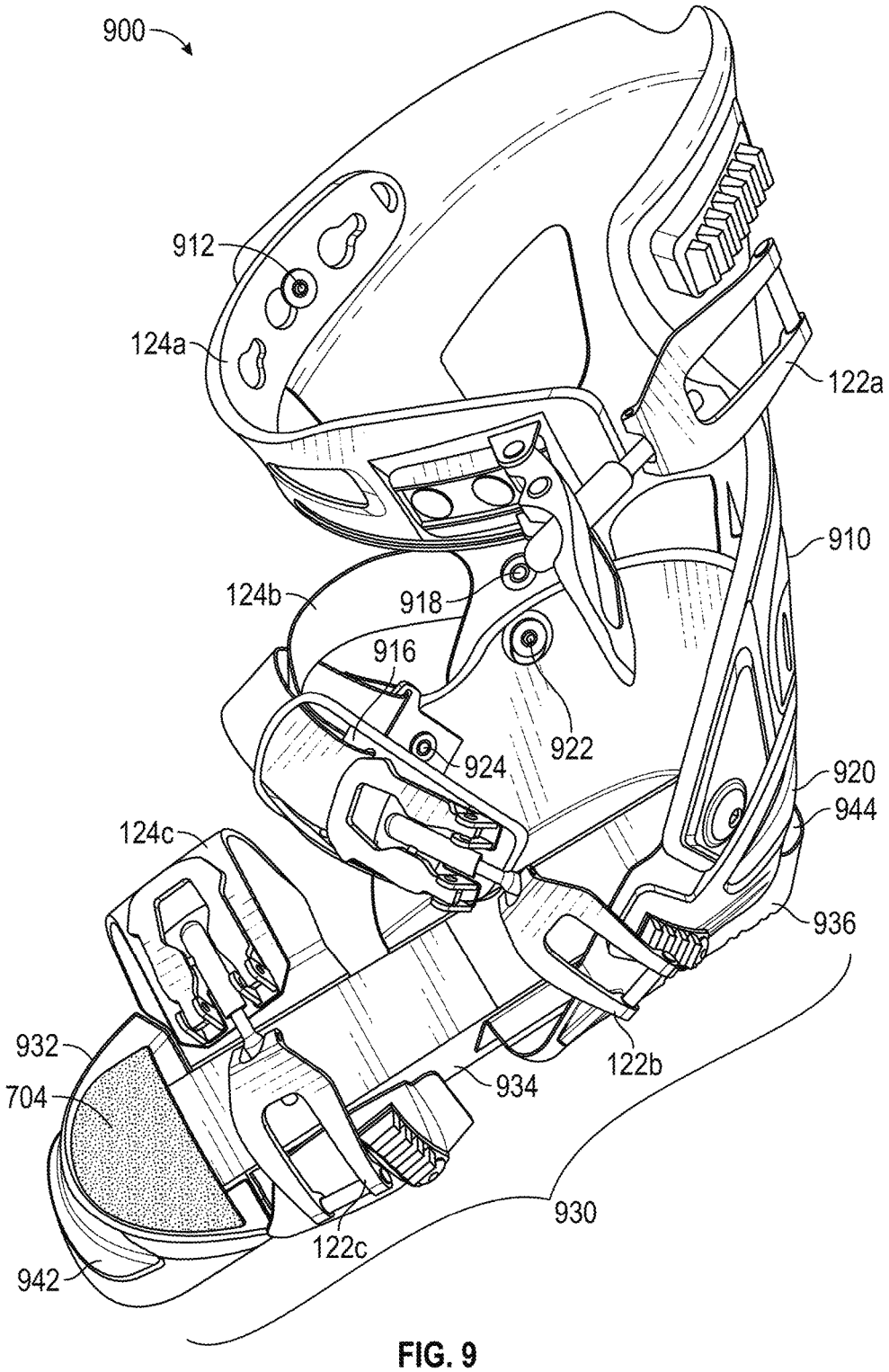
FIG. 9 is a front perspective view of an embodiment of the frame of FIG. 1.

FIG. 9 is a front perspective view of an embodiment of the frame of FIG. 1. In an embodiment, a frame 900 can be similar to the frame 120. The frame 900 can have a heel cuff 910 and a heel cup 920. The heel cuff 910 and the heel cup 920 can have internal dimensions and shape complementary to the heel 152 of the walking boot 110. This can allow the heel cuff 910 and the heel cup 920 to receive the walking boot 110 in a clearance fit. The heel cuff 910 can have the upper strap 124*a* coupled to the top of the heel cuff 910 at a connection point 912. The buckle 122*a* and the upper strap 124*a* can secure the top of the walking boot 110 in place.

The heel cuff 910 can also have the buckle 122*b* and the associated Y-shaped strap 124*b*. The Y-shaped strap 124*b* can formed of an inelastic fabric or other flexible strap material. The Y-shaped strap 124*b* can further be coupled to a turning ring 916 that can allow the user to vary the tension of the Y-shaped strap 124*b* across the instep of the walking boot 110. In some embodiments, the strap 122*b* can slide through the turning ring 916. The turning ring 916 can be coupled to the buckle 122*b* and allowed to pivot slightly as the buckle 122*b* is actuated. The turning ring 916 can then self-align according to the tension applied to the strap 122*b* by the buckle 122*b*. In some other embodiments, a length of the strap 124*b* can be adjusted using a hook-and-loop type of strap, such as VELCRO™. In other embodiments, one end of the Y-shaped strap 124*b* can be attached at an attachment point 918. The other end of the Y-shaped strap 124*b* can be attached to the heel cup at an attachment point 924. In another embodiment, the one end of the Y-Shaped strap 124*b* can be attached at a hinging point 922 between the heel cuff 910 and the heel cup 920. The hinging point 922 can provide some degree of articulation between the heel cuff 910 and the heel cup 920.

The frame 900 can have a shank 930. The shank 930 can be coupled to the heel cuff 910 and/or the heel cup 920. The shank 930, the heel cup 920, and the heel cuff 910 in conjunction can enclose the heel 152 and can provide rigid support to the exoskeletal boot 100 in use.

In some embodiments, the shank 930 can have a toe cup 932, a structural bridge 934, and a heel section 936. The shank 930 can also have a toe sole 942 and a heel sole 944 that can be formed such that the frame 900 can be accepted into a typical ski binding (e.g., ISO standard ski bindings). In some embodiments, the shank 930 can conform to standard DIN norms and thus also be referred to as a DIN sole or an ISO sole. In some embodiments, the toe cup 932 can be formed similar to the toe cup 702 (FIG. 8). In some other embodiments, the toe cup 932 can have the textured surface 704 similar to above. In other embodiments, the toe cup 932 may not have a portion analogous to the top section 710 of the toe cup 702 that can overlap the toe section 158 of the walking boot 110.

The structural bridge 934 can connect the toe cup 932 to the heel section 936. Thus each portion of the shank 930 can be formed independently and fastened together via one or more fasteners (not shown). In some other embodiments, the shank 930 can be formed as a unitary piece.

Figure 10:
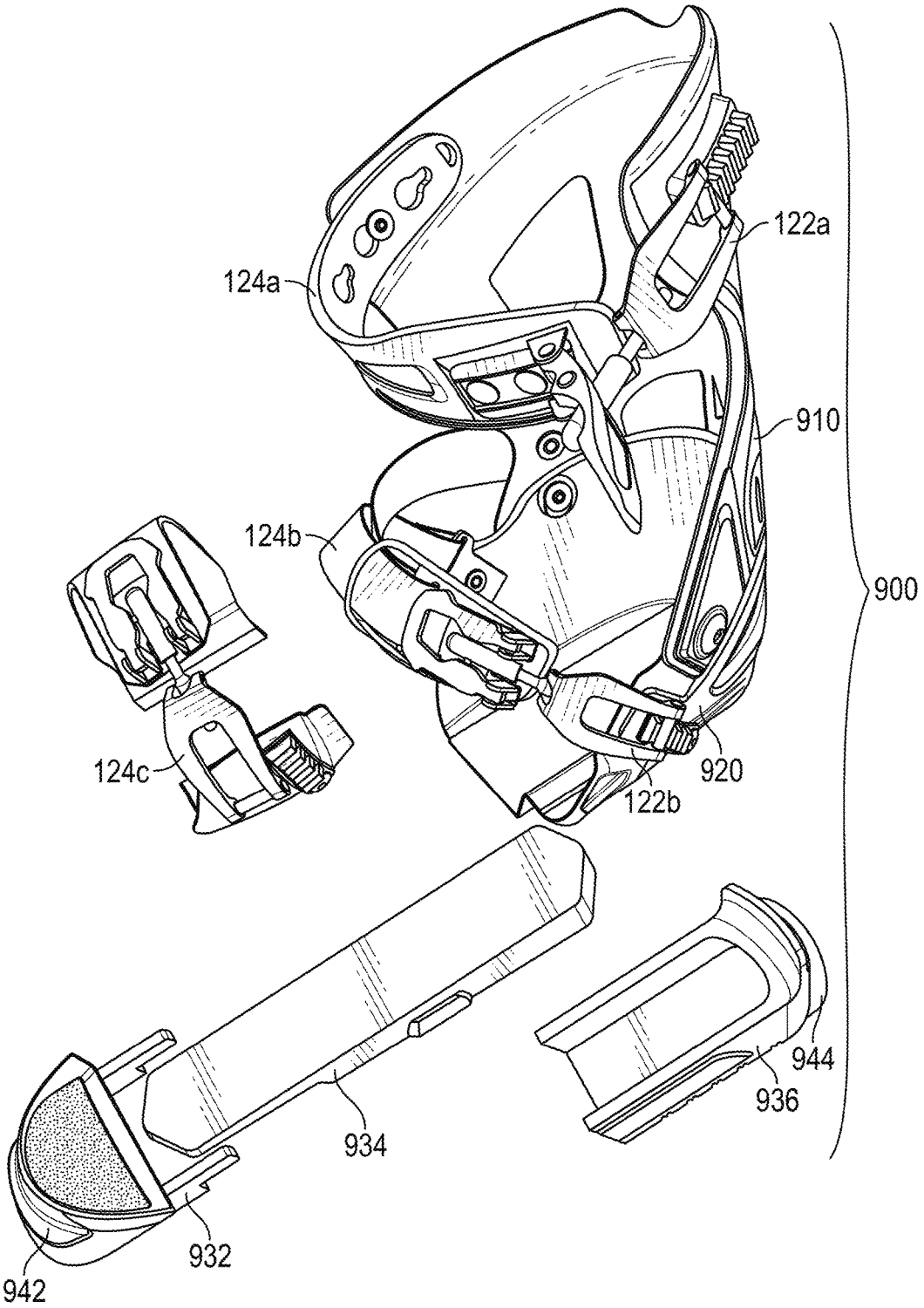
FIG. 10 is an exploded view of the frame of FIG. 9.

FIG. 10 is an exploded view of the frame of FIG. 9. As shown, the heel cuff 910 can be formed separate of the shank 930. The shank 930 can have the toe block 932, the toe cup 932, the bridge 934, and the heel section 936.

Figure 11:
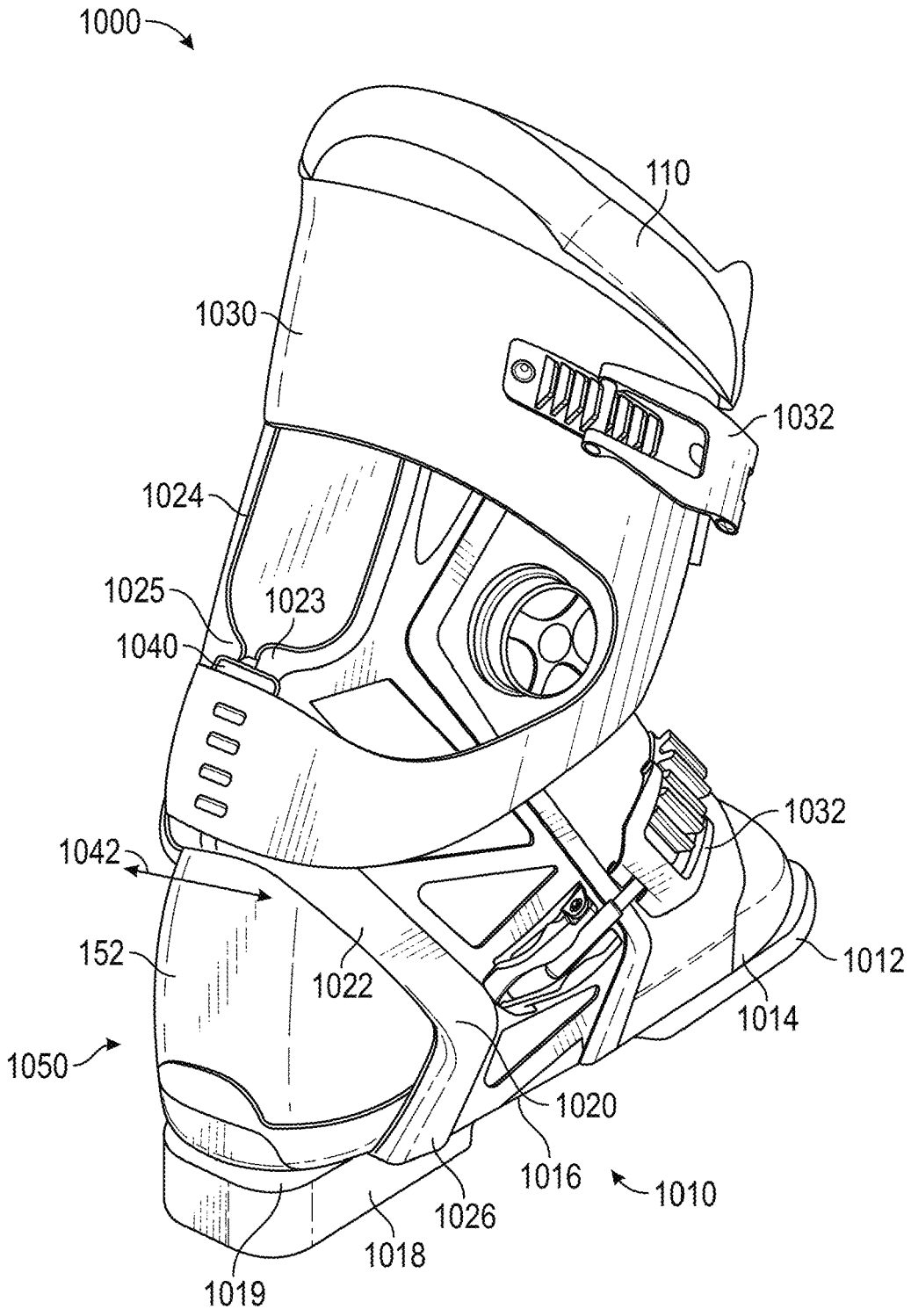
FIG. 11 is a rear perspective of an embodiment of the boot.

FIG. 11 is a rear perspective of another embodiment of the boot. An exoskeletal boot 1000 can have the walking boot 110, a frame 1020, and a support cuff 1030. The frame 1020 can be sized to receive the walking boot 110 in a clearance fit and be secured to the frame 1020 via the use of the support cuff 1030 and one or more buckles 1032. The buckles 1032 can be similar to the buckles 122 described above.

In some embodiments, the frame 1020 can have a shank 1010. The shank 1010 can be similar to the shank 930. The shank 1010 can be formed from a toe sole 1012, a toe cup 1014, a structural bridge, 1016, and a heel portion 1018. Each of the toe sole 1012, the toe cup 1014, the structural bridge 1016, and the heel portion 1018 can be individually formed and secured together to form the shank 1010. In some other embodiments, the shank 1010 can have a unitary construction. The heel portion 1018 can also have a heel sole 1019 for use with the toe sole 1012 in, for example, a typical ski binding.

The frame 1020 can also have a lateral frame support 1022 and a medial frame support 1024. The lateral frame support 1022 and the medial frame support 1024 can be secured to the shank 1010 via a fastening means (not shown) at a bottom section 1026. Such fastening means can be snap-together protrusions, screws or bolts, as needed for a given design. In some embodiments, each of the foregoing components can be individually constructed from a variety of composites (e.g., FRP, carbon fiber) using a mold or via some kind of injection molding or other forming process. In some other embodiments, the frame 1020 can be formed as a unitary whole.

In use with the walking boot 110, the support cuff 1030 can wrap around the lateral frame support 1022 and the medial frame support 1024 to secure the walking boot 110 in place within the frame 1020. The support cuff 1030 can be secured in place about the user's leg using one or more of the buckles 1032.

In FIG. 11, the frame 1020 can have an open heel cup 1050. When the walking boot 110 is inserted into the open heel cup 1050, the heel 152 (FIG. 3) can protrude through the open heel cup 1050. This aspect allows the frame 1020 to capture the heel 152 of the walking boot 110 and minimize relative movement between the components. This can further avoid excess sole length of a solid or enclosed heel cup similar to that of FIG. 9. In some embodiments, a shorter sole length can reduce weight, bulk, and improve the connection between the exoskeletal boot 1000, or for example, a skier and ski.

In some embodiments, the lateral frame support 1022 can have a lateral heel flange 1023 and the medial frame support 1024 can have a medial heel flange 1025. The lateral heel flange 1023 and the medial heel flange 1025 can be joined together by a rear connector 1040. The rear connector 1040 can join the lateral frame support 1022 and the medial frame support 1024 of the frame 1020 together and provide a width adjustment. The rear connector 1040 can increase or decrease a distance between the lateral heel flange 1023 and the medial heel flange 1025 in the direction noted by arrows 1042 in the medial-lateral direction. Adjustment of the rear connector 1040 can be performed at the manufacturing, retail, or user level. The rear connector 1040 can allow precise and individualized fit to the walking boot 110. In some embodiments, the rear connector 1040 can be formed having various thicknesses between the lateral heel flange 1023 and the medial heel flange 1025 (and both sides of the open heel cup 1050) to allow an adjustable heel width. In some embodiments, the rear connector 1040 can also allow vertical adjustment of the support cuff 1030 as described below in connection with FIG. 12.

Figure 12:
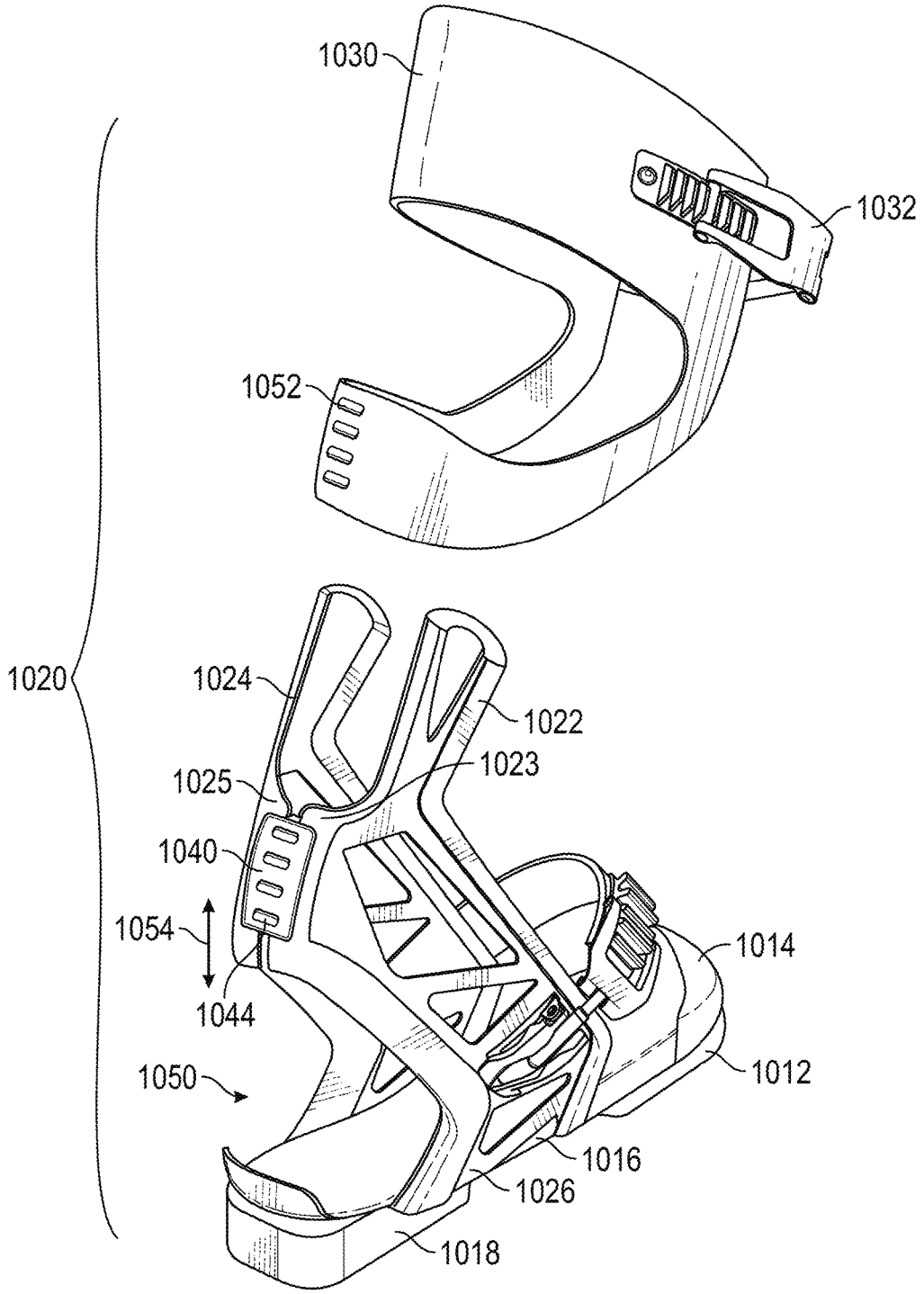
FIG. 12 is an exploded view of the embodiment of FIG. 11.

FIG. 12 is an exploded view of the embodiment of FIG. 11. FIG. 12 depicts the support cuff 1030 removed from the frame 1020. The support cuff 1030 can be removed or decoupled from the frame 1020 via the rear connector 1040 and the cuff connector 1052. The cuff connector 1052 can allow adjustment of vertical height of the support cuff 1030 in a direction indicated by the arrows 1054. In some embodiments, the support cuff 1030 can secure the walking boot 110 within the frame 1020. The cuff connector 1052 can be formed to receive one or more protrusions 1044 formed in the rear connector 1040.

Figure 13:
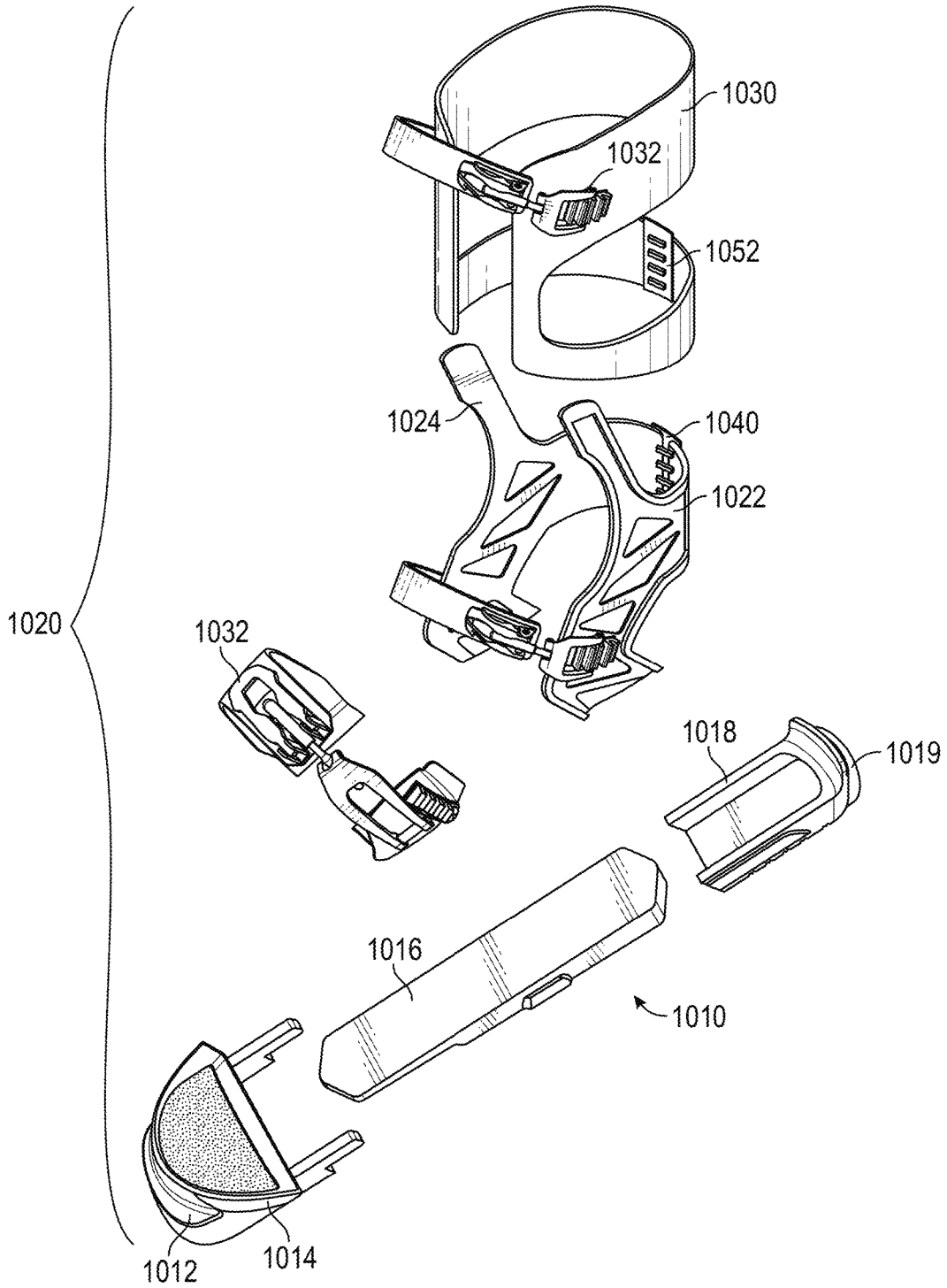
FIG. 13 is another exploded view of the frame of FIG. 11.

FIG. 13 is another exploded view of the frame of FIG. 11. As shown, each component of the frame 1020 can be formed as an individual piece, providing ease of construction and interchangeability of parts.

In some embodiments, the toe cup 1014 can be formed similar to the toe cup 702 of FIG. 8. In some embodiments, the toe cup 1014 can have a top section similar the top section 710. In some embodiments, the toe cup 1014 may not require such a feature. The structural bridge 1016 can provide rigidity to the frame 1020 and serve as a connection point between the toe sole 1012 and the toe cup 1014, and the heel portion 1018. The heel portion 1018 can also have a heel sole 1019. The heel sole 1019 in conjunction with the toe sole 1012 can allow the frame 1020 and the walking boot 110 to be used with a typical ski binding (e.g., an ISO heel sole).

Figure 14:
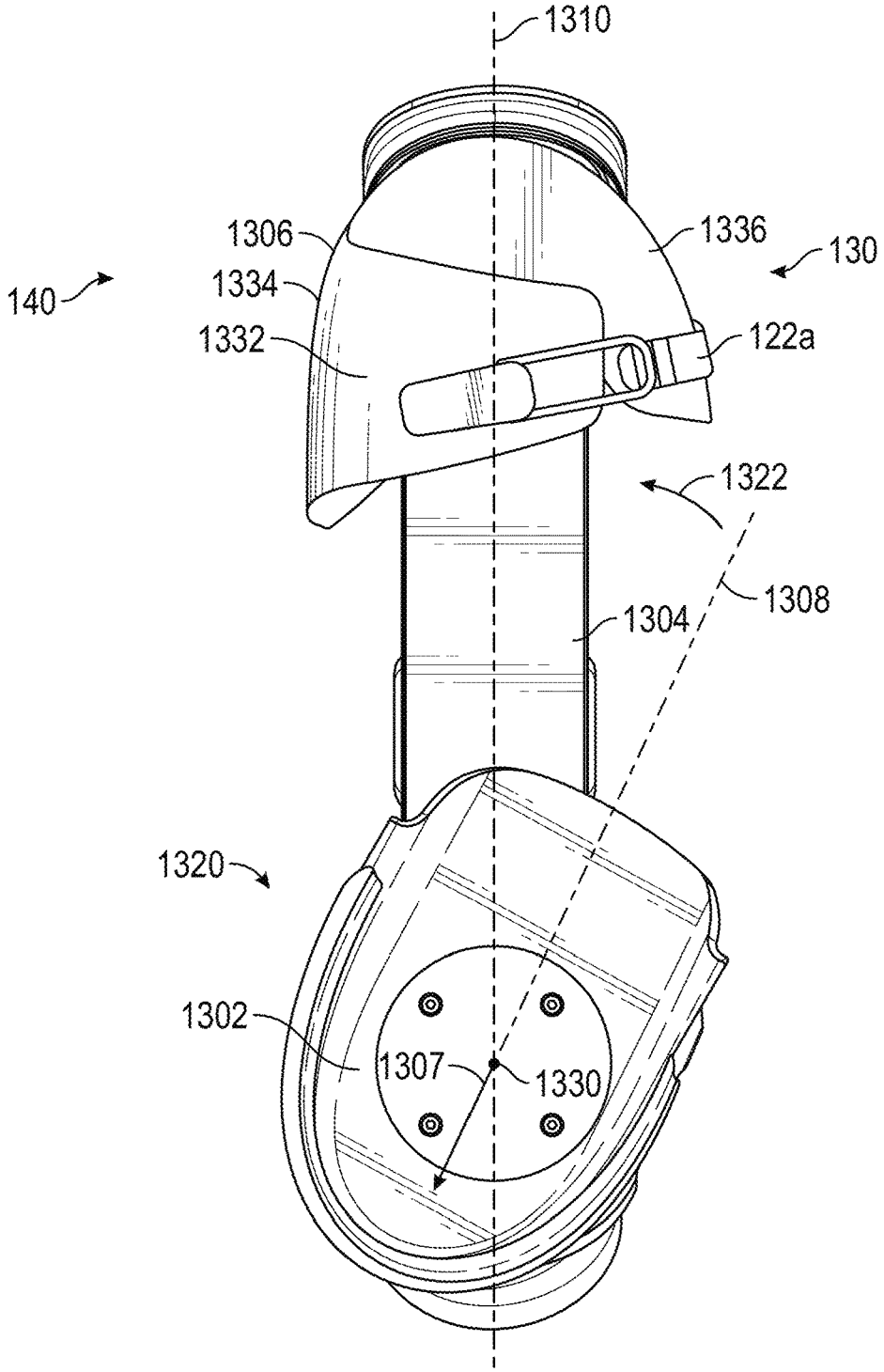
FIG. 14 is a top cutaway view of another embodiment of the exoskeletal boot of FIG. 1.

FIG. 14 is a top cutaway view of another embodiment of the exoskeletal boot of FIG. 1. In some embodiments, the exoskeletal boot 100 can have a frame 1320. The frame 1320 can be similar to the frame 120. The frame can have the lateral side 130 and the medial side 140 (FIG. 1). The medial side 140 can have a medial side panel 1334. The lateral side 130 can have a lateral side panel 1336.

The frame 1320 can also have a heel cup 1302 that can pivot or rotate with respect to a structural bridge 1304 and toe section 1306. The heel cup 1302 can also be referred to herein as a rotatable heel cup 1302. The heel cup 1302 can be formed to receive the heel 152 of the walking boot 110 and allow the walking boot heel to enter into and protrude through the rear opening (e.g. similar to the open heel cup 1050 of FIG. 11) area of the heel cup 1302. The walking boot 110 can slide unencumbered in a rearward direction indicated by the arrow 1307, approximately parallel to an axis 1308 (noted in a dashed line) of the heel cup 1302. The heel 152 of the walking boot 110 can then be positioned securely back into the open heel cup 1302. Thus, the heel cup 1302 can allow the walking boot 110 to enter the heel cup 1302 at an angle from a centerline 1310 (shown in a dashed line) which can be approximately 45 degrees. In some embodiments, such an angle can be less than 45 degrees. The walking boot 110 can be secured into the heel cup 1302 via buckling of, for example, the Y-shaped strap **124*b* and the buckle 122*b* (FIG. 1). In such an embodiment, the walking boot 110 and the heel cup 1302 can then rotate together in a direction indicated by an arrow 1322**, aligning the axis 1308 with the centerline 1310. The rotation can occur about a pivot point 1330 located in the rear half of the boot at approximately a center of the heel cup 1302.

As the walking boot 110 and the heel cup 1302 are rotated in the direction 1322, the centerline (e.g., the centerline 400) of the walking boot 110 and the heel cup 1302 are aligned along a common heel to toe axis (e.g., the axis 1308 and the centerline 1310). In this configuration, the toe section 158 of the walking boot 110 can engage a fixed flange 1332 on the medial side panel 1334 that extends upward from the forward medial 140 side of the frame 1320 and the toe section 1306. When the toe section 158 of the walking boot 110 is fully engaged with the fixed flange 1332, a strap/buckle system or other means of fixation secures the components together into a single unit with minimal relative motion. In some embodiments, the buckle 122*a* and the upper strap 124*a* (FIG. 2) can be used for this purpose.

As shown in FIG. 14, the heel cup 1302 is rotated or pivoted away from the centerline 1310 to receive the heel 152 of the walking boot 110. In this configuration, the heel 152 of the walking boot can be inserted into the heel cup 1302. The pivoting heel cup 1302 can be enabled by a disk with the fixed flange 1332 arrangement that can allow the heel cup 1302 and the walking boot 110 to rotate through an arc of controlled range in the direction 1322. The fixed flange 1332 can capture the toe section 158 and secure it in place. With the walking boot 110 in place and the buckle 122*a* engaged, the heel cup 1302 can prevent medial/lateral bending relative to the structural bridge 1304 of the chassis during skiing maneuvers.

Figure 15:
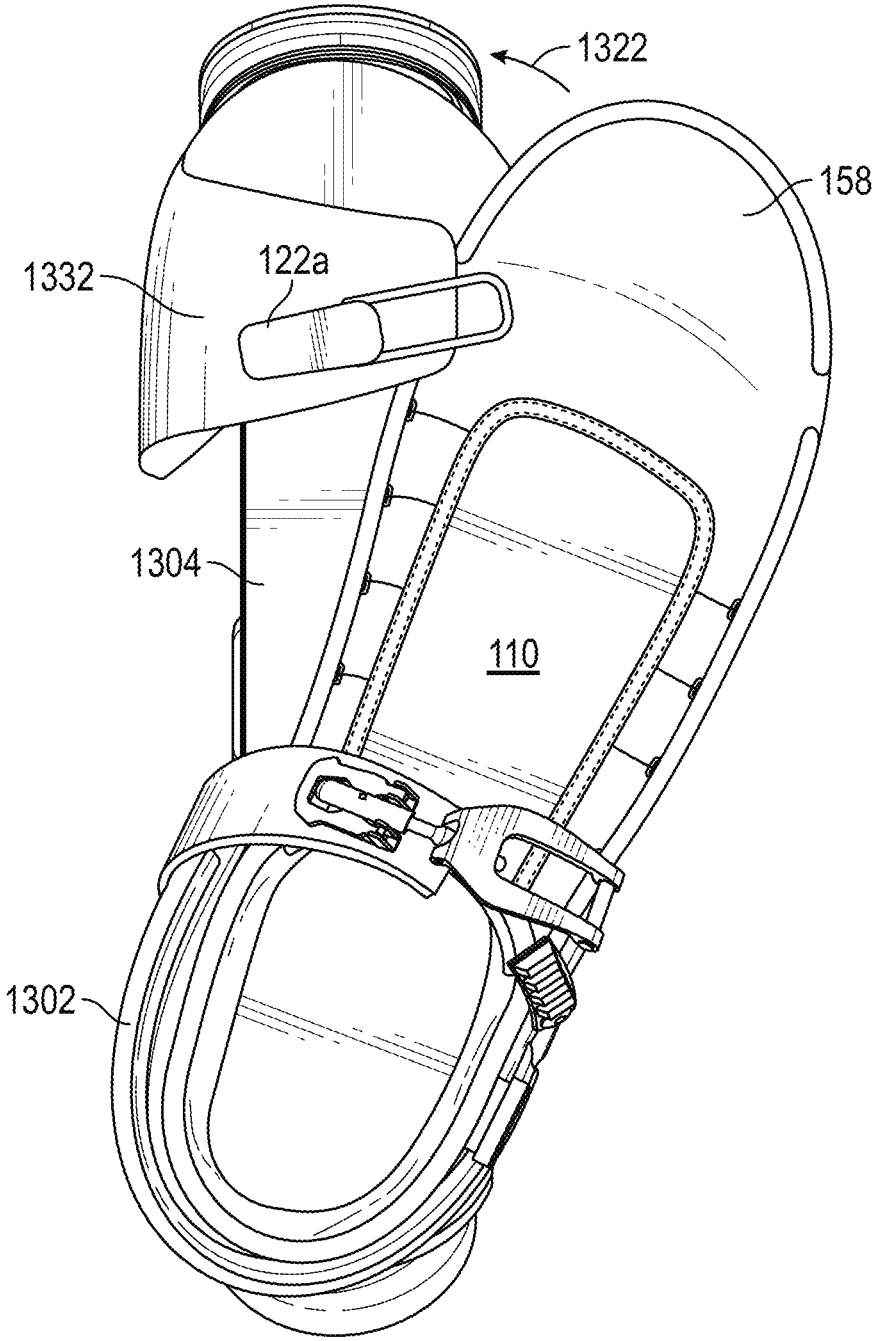
FIG. 15 is a top plan view the embodiment of FIG. 14.

FIG. 15 is a top plan view the embodiment of FIG. 14. As shown, the walking boot 110 can be slid rearward into the heel cup 1302. With the walking boot 110 inserted in the heel cup 1302, the strap 124*b* and the buckle 122*b* can be engaged to firmly couple the walking boot 110 into the heel cup 1302 prior to rotation of the walking boot 110 and heel cup 1302 in the direction 1322 to a centered position in line with the centerline 1310.

Figure 16:
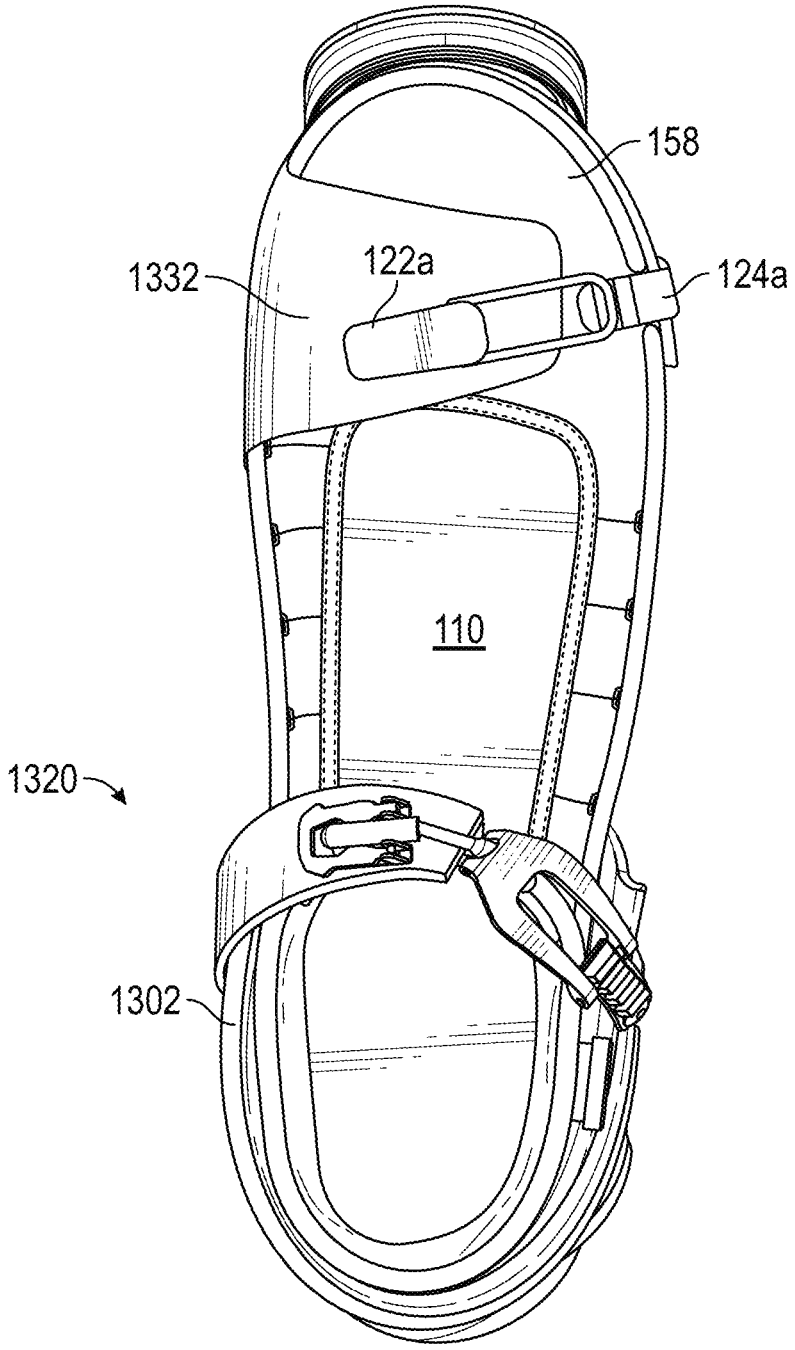
FIG. 16 is another top plan view of the embodiment of FIG. 14.

FIG. 16 is another top plan view of the embodiment of FIG. 14. As shown, the walking boot 110 and the heel cup 1302 can be rotated to the centerline 1310. The toe section 158 can come in contact with the fixed flange 1332. The toe section can then be secured in place using a fastening means. In some embodiments, the buckle 122*a* and the upper strap 124*a* can be used for this purpose.

Figure 17:
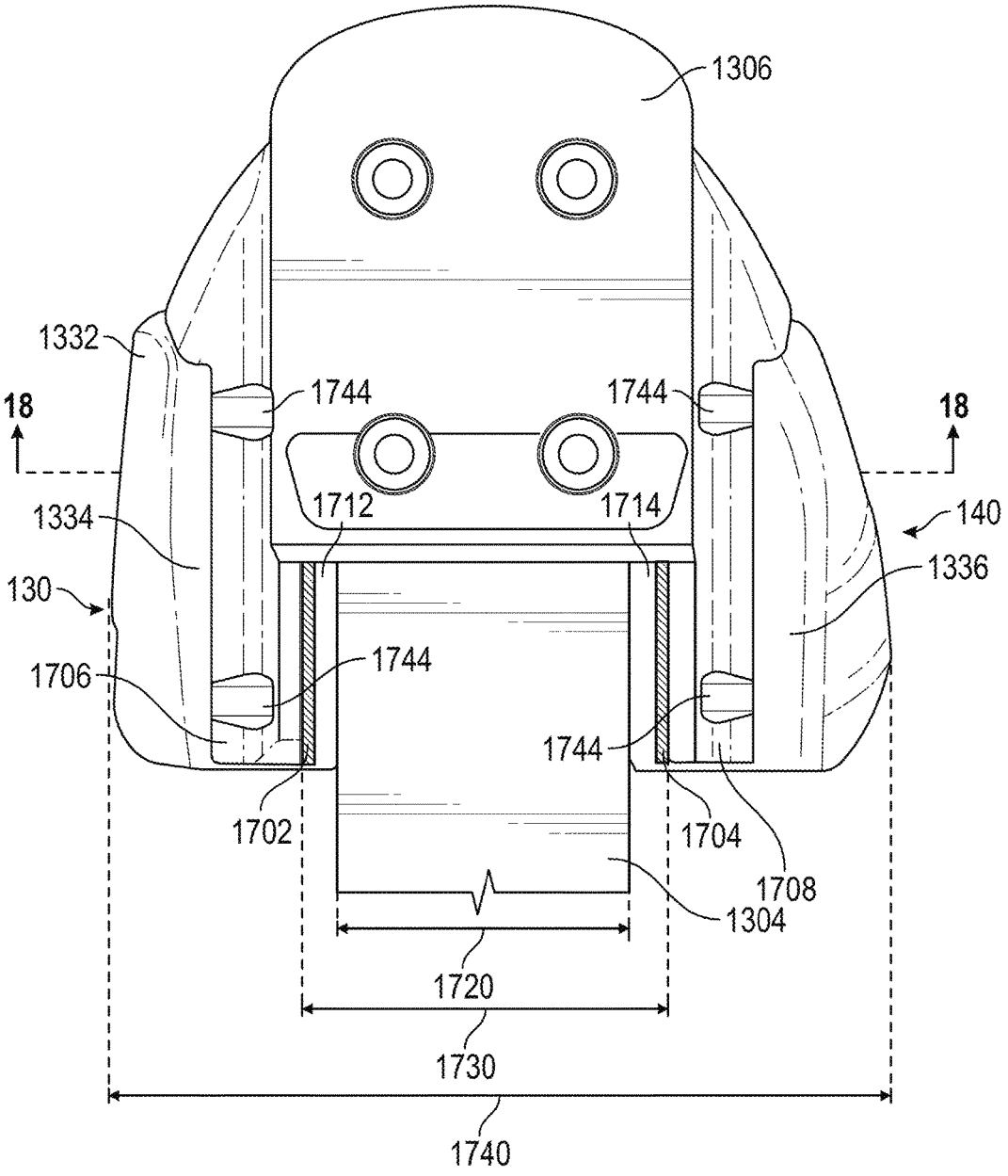
FIG. 17 is a sectional view of an embodiment of the exoskeletal boot of FIG. 13.

FIG. 17 is a sectional view of an embodiment of the exoskeletal boot of FIG. 13. This view shows the bottom of the toe section 1306 and the structural bridge 1304. The toe section 1306 can be formed to receive the structural bridge 1304 in a clearance fit. The structural bridge 1304 can have an external width 1720 that is less than an internal width 1730 of the toe section 1306. The additional space allows for use of shims 1702, 1704. The shims 1702, 1704 can allow for adjustment of an overall width 1740 of the toe section 1306 to allow for use with different sized walking boots 110.

As shown, the medial side panel 1334 can have a medial flange 1712. Similarly, the lateral side panel 1336 can have a lateral flange 1714. Additionally, the toe section 1306 can have a medial extension 1706 and a lateral extension 1708. When constructed, the toe section 1306 can be coupled to the structural bridge 1304. When coupled, the lateral flange 1714 can be captured between the lateral extension 1708 and the structural bridge 1304. The shims 1702, 1704 can be used to adjust the overall width 1740 of the toe section 1306. For example, when the shim 1702 is placed between the medial flange 1712 and the medial extension 1706 and when the shim 1704 is placed between the lateral flange 1714 and the medial extension 1706 the overall width 1740 has a minimum overall width 1740. The minimum overall width 1740 can be achieved when the medial extension 1706 and the lateral extension 1708 are in contact with the structural bridge 1304.

Figure 18:
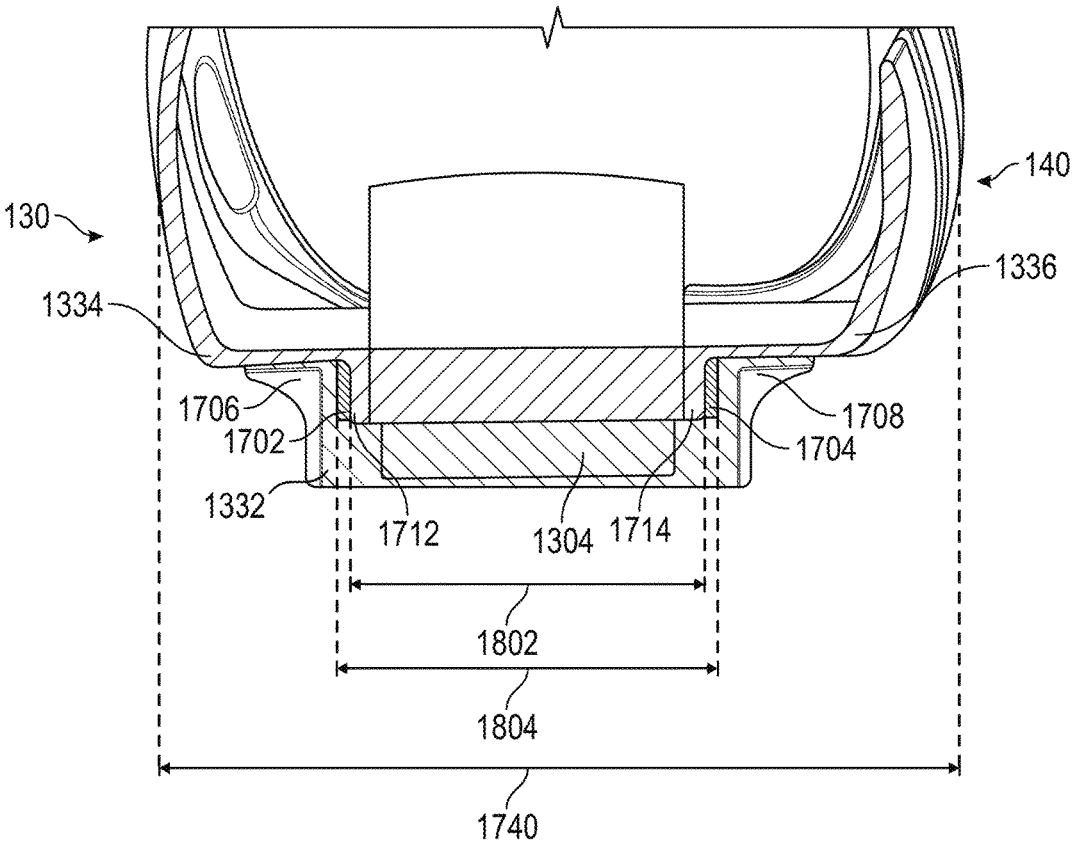
FIG. 18 is a cross sectional view taken along the line 18-18 of FIG. 17.

FIG. 18 is a cross sectional view taken along the line 18-18 of FIG. 17. As shown, the shims 1702 can be inserted between the medial flange 1712 and the medial extension 1706. Similarly, the shim 1704 can placed between the lateral flange 1714 and the lateral extension 1708, again placing both the medial flange 1712 and the lateral flange 1714 in contact with the structural bridge 1304. This can reduce overall width 1740 to a minimum value.

Figure 19:
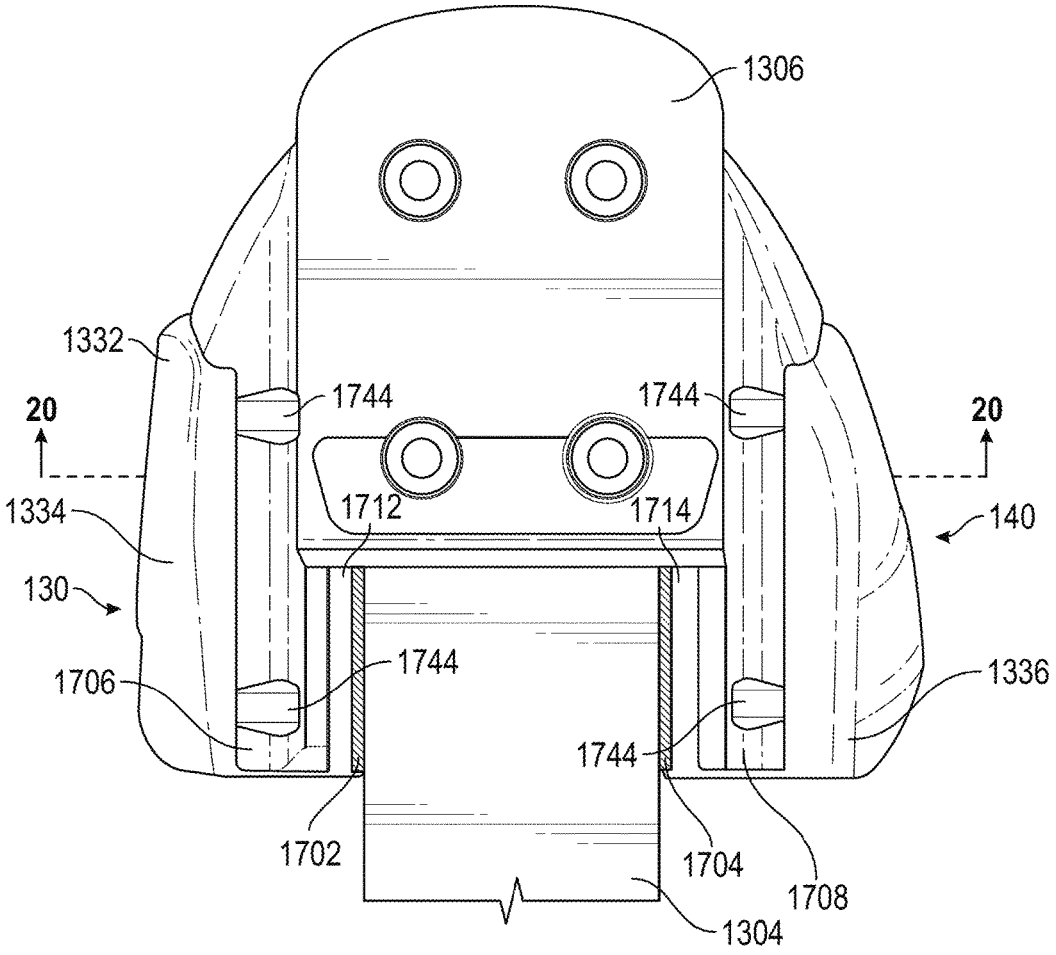
FIG. 19 is sectional view of an embodiment of the exoskeletal boot of FIG. 13.

FIG. 19 is sectional view of an embodiment of the exoskeletal boot of FIG. 13. In another embodiment, the shim 1702 can be inserted between the structural bridge 1304 and the medial flange 1712. In a similar fashion, the shim 1704 can be inserted between structural bridge 1304 and the lateral flange 1714. This can place the medial flange 1712 in contact with the medial extension 1706, and the lateral flange 1714 in contact with the lateral extension 1708. This can increase the overall width 1740 to a maximum value. In some embodiments, the shims 1702, 1704 can have various thicknesses, in order to allow intermediate positioning of the medial flange 1712, the lateral flange 1714 and the associated the medial side panel 1334 and the lateral side panel 1336.

Figure 20:
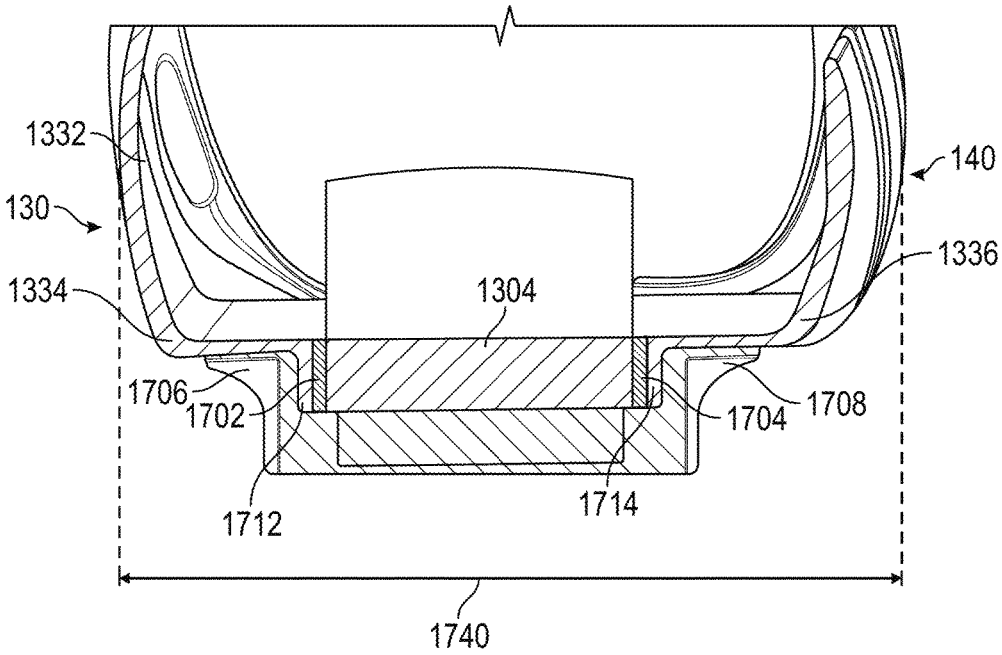
FIG. 20 is a cross sectional view taken along the line 20-20 of FIG. 19.

FIG. 20 is a cross sectional view taken along the line 20-20 of FIG. 19. As shown, the shim 1702 can be inserted between the structural bridge 1304 and the medial flange 1712 while the shim 1704 is inserted in between the structural bridge 1304 and the lateral flange 1714.

In the embodiments of FIG. 17-FIG. 20, fasteners can attach side panels (e.g., the lateral side panel 1336 and the medial side panel 1334) to the structural bridge 1304 via openings 1744 (FIG. 17 and FIG. 19). The fasteners (not shown) can serve to capture the shims 1702, 1704 while allowing easy adjustment at both the manufacturing and retail level. The shims 1702, 1704 can be die cut or molded plastic, shaped to integrate with the finished assembly.

In some embodiments, the attachment of the medial side panel 1334 and the lateral side panel 1336 using the shims 1702 and the shims 1704 can also allow asymmetrical adjustment of the overall width 1740. In some embodiments, the shims 1702, 1704 can be used in different configurations on both sides of the medial flange 1712 and the lateral flange 1714. This can provide flexibility in adjustment and intermediate width intervals in the finished dimensions (e.g., the overall width 1740) of the frame (e.g., the frame 120, the frame 900, the frame 1320) of the exoskeletal boot 100.

Additionally, asymmetrical positioning of the shims 1702, 1704 provides a means of adjusting the longitudinal axis of the walking boot 110 with respect to the longitudinal axis (e.g., the centerline 1310) of the frame (e.g., the frame 1320). This adjustment may be desirable for ski technique or performance reasons as well as providing the ability to accommodate walking boots of different shapes into the chassis (e.g., the frame 120, the frame 900, the frame 1320) while preserving desired alignment of the two boot components.

It should be further noted that the aspects of the disclosures of FIG. 17 through FIG. 20 can be combined with other embodiments disclosed herein. For example, the shims 1702, 1704 can be incorporated into the embodiments of FIG. 9 through FIG. 13. Accordingly, shims 1702, 1704 can also be implemented to adjust the width of the frame 120, the frame 900, and the frame 1020. In some embodiments, shims, similar to the shims 1702, 1704 can be implemented in the frame 1020, for example, between the lateral frame support 1022, the medial frame support 1024, and the heel portion 1018 to allow further adjustment of the frame 1020 and accommodate different sized walking boots 110. It should also be noted that the other aspects of the disclosure can be combined as needed.

Although embodiments of various methods and devices are described herein in detail with reference to certain versions and applications, it should be appreciated that other versions, embodiments, methods of use, and combinations thereof are also possible. Therefore the spirit and scope of the descriptions should not be limited to the embodiments contained herein but should also consider any combination of the aspects described.

What is claimed is:

1. A walking boot for use with an exoskeletal boot, the walking boot comprising:

a lateral panel portion having a first edge, a medial panel portion joined to the lateral panel portion, the medial panel portion having a second edge, a tongue having an upper portion, a lower portion, a lateral edge, and a medial edge, the lateral edge overlapping the first edge and the medial edge overlapping the second edge;

the tongue further having a top panel and a bottom panel;

at least one lace routed internally in the tongue below the top panel and above the bottom panel, the at least one lace configured to draw the tongue toward the lateral panel portion and the medial panel portion; and a first turning guide directly attached to the bottom panel of the tongue, the first turning guide having a first lace channel, wherein the first lace channel is below the top panel and is above the bottom panel of the tongue such that the first lace channel is positioned in between the top panel and the bottom panel; and a second turning guide disposed on either the lateral panel portion or the medial panel portion, the second turning guide having a second lace channel, wherein the second turning guide is entirely spaced apart from either the first edge of the lateral panel portion or the second edge of the medial panel portion, the second turning guide being entirely spaced apart from the tongue and from the lateral and medial edges of the tongue.

2. The walking boot of claim 1, wherein the at least one lace is routed through the first lace channel, wherein the first lace channel is positioned in the lower portion of the tongue, and wherein the at least one lace is further routed through a third lace channel in the medial panel portion and a fourth lace channel in the lateral panel portion.

3. The walking boot of claim 1, further comprising an outer mid-foot panel having a third edge, and an inner mid-foot panel having a fourth edge, wherein the at least one lace is routed in a serpentine manner between the lateral edge and the third edge without crossing a centerline of the tongue, and wherein the at least one lace is routed in a serpentine manner between the medial edge and the fourth edge without crossing the centerline of the tongue.

4. The walking boot of claim 1, wherein the tongue is molded to provide overlap with the lateral panel portion and the medial panel portion while remaining flexible and adapted to a user's foot.

* * * * *